US007300550B2

(12) United States Patent
Sabourin et al.

(10) Patent No.: US 7,300,550 B2
(45) Date of Patent: Nov. 27, 2007

(54) HIGH INTENSITY REFINER PLATE WITH INNER FIBERIZING ZONE

(75) Inventors: Marc J. Sabourin, Huber Heights, OH (US); Luc Gingras, Lake Oswego, OR (US)

(73) Assignee: Andritz Inc., Glens Falls, NY (US)

( * ) Notice: Subject to any disclaimer, the term of this patent is extended or adjusted under 35 U.S.C. 154(b) by 230 days.

(21) Appl. No.: 11/009,482

(22) Filed: Dec. 10, 2004

(65) Prior Publication Data

US 2006/0006265 A1 Jan. 12, 2006

Related U.S. Application Data

(63) Continuation-in-part of application No. 10/888,135, filed on Jul. 8, 2004.

(51) Int. Cl.
*D21D 1/30* (2006.01)
*B02C 7/02* (2006.01)
*B02C 7/12* (2006.01)

(52) U.S. Cl. ..... 162/261; 162/23; 162/28; 162/68; 241/28; 241/261.3; 241/298

(58) Field of Classification Search ..... 162/13, 162/18, 23, 28, 56, 68, 261; 241/28, 261.2, 241/261.3, 296, 298
See application file for complete search history.

(56) References Cited

U.S. PATENT DOCUMENTS 5,248,099 A * 9/1993 Lahner et al. ..... 241/28
5,335,865 A * 8/1994 Kohler et al. ..... 241/28
5,695,136 A * 12/1997 Rohden et al. ..... 241/261.3
6,311,907 B1 * 11/2001 Gingras ..... 241/28
6,402,071 B1 * 6/2002 Gingras ..... 241/261.2
2004/0118959 A1 6/2004 Virving

FOREIGN PATENT DOCUMENTS

WO WO 2004/009900 A1 1/2004

OTHER PUBLICATIONS

Brochure—"Turbine Segments"—Metzo Paper, date unknown.

* cited by examiner

*Primary Examiner*—Eric Hug
(74) *Attorney, Agent, or Firm*—Alix, Yale & Ristas, LLP

(57) ABSTRACT

Plate elements, a plate configuration, and associated system for thermomechanical refining of wood chips wherein destructured and partially defibrated chips are fed to a rotating disc primary refiner, where opposed discs each have an inner band pattern of bars and grooves and outer band pattern of bars and grooves, such that substantially complete fiberization (defibration) of the chips is achieved in the inner band and the resulting fibers are fibrillated in the outer band. A pair of opposed co-operating refining plate elements for a flat disc refiner wherein the bars and grooves on each of the inner bands form an inner feed region followed by an outer working region, the bars and groove on each of the outer bands form an inner feed region followed by an outer working region, and the gap and/or material flow area formed when the plates are placed in front of each other increases between the inner working region and the outer feed region. A steam bypass channel is formed as a groove on the surface of the working region of the inner band.

19 Claims, 25 Drawing Sheets

HIGH INTENSITY REFINER PLATE WITH INNER FIBERIZING ZONE

RELATED APPLICATION

This application is a continuation-in-part of pending U.S. application Ser. No. 10/888,135 filed Jul. 8, 2004, entitled, "Energy Efficient TMP Refining of Destructured Chips", the benefit of which is claimed under 35 U.S.C. 120 and 121, and the disclosure of which is incorporated by reference.

BACKGROUND OF THE INVENTION

The present invention relates to apparatus and method for thermomechanical pulping of lignocellulosic material, particularly wood chips.

In recent decades, the quality of mechanical pulp produced by thermomechanical pulping (TMP) techniques has been improving, but the rising cost of energy for these energy-intensive techniques imposes even greater incentives for energy efficiency while maintaining quality. The underlying principle in the progression of recent developments toward energy efficiency while maintaining quality, has been to distinguish and handle in distinct equipment, the axial fiber separation and fiberization of the chip material, from the fibrillation of the fibers to produce pulp. The former steps are performed in dedicated equipment upstream of the refiner, using low energy consumption that matches the relatively low degree of working and fiber separation, while the high energy consuming refiner is relieved of the energy-inefficient defibering function and can devote all the energy more efficiently to the fibrillation function. This is necessary since the fibrillation function requires even more energy than defibering (also known as defibration).

These developments did indeed improve energy efficiency, especially in systems that employ high-speed discs. However, especially for systems that did not employ high-speed refiners, the long-term energy efficiency was offset to some extent in the short term by the need for more costly or more space-occupying equipment upstream of the primary refiner.

SUMMARY OF THE INVENTION

The object of the invention is to provide a refiner plate configuration that promotes the production of high quality thermomechanical pulps at lower energy consumption.

In essence, the invention achieves significant energy efficiency, even in systems that do not employ a high speed refiner, while reducing the scope and complexity of the equipment needed upstream of the refiner.

In a broad aspect, the invention is directed to plate elements, a plate configuration, and associated system for thermomechanical refining of wood chips wherein destructured and partially defibrated chips are fed to a rotating disc primary refiner, where opposed discs each have an inner band pattern of bars and grooves and an outer band pattern of bars and grooves, such that substantially complete fiberization (defibration) of the chips is achieved in the inner band and the resulting fibers are fibrillated in the outer band.

One embodiment is directed to a pair of opposed cooperating refining plate elements intended for a flat disc refiner for the disintegration and refining of lignocellulosic material in a refining gap between two opposed relatively rotating refining discs, where the plate elements are intended to be placed directly in front of each other on opposed refining discs, wherein the improvement comprises that both plate elements are formed with an inner band including bars and grooves and an outer band including bars and grooves, the bars and grooves on each of the inner bands form an inner feed region followed by an outer working region, the bars and groove on each of the outer bands form an inner feed region followed by an outer working region, and the gap and/or material flow area formed when the plates are placed in front of each other increases between the inner working region and the outer feed region.

Preferably, the working region of the inner band is defined by a first pattern of alternating bars and grooves, and the feeding region of the outer band is defined by a second pattern of alternating bars and grooves. The first pattern on the working region on the inner band has relatively narrower grooves than the grooves of the second pattern on the feeding region on the outer band such that a discontinuity in the geometry is created. The fiberization of the chips is substantially completed in the working region of the inner band with low intensity refining, while the fibrillation of the fibers is performed in the working region of the outer band at a smaller plate gap and higher refining intensity.

The associated method preferably comprises the steps of exposing the chips to an environment of steam to soften the chips, compressively destructuring and dewatering the softened chips to a consistency greater than about 55%, diluting the destructured and dewatered chips to a consistency in the range of about 30% to 55%, feeding the diluted destructured chips to a rotating disc refiner, where opposed discs each have an inner band pattern of bars and grooves and an outer band pattern of bars and grooves, fiberizing (defibrating) the chips in the inner band, and fibrillating the resulting fibers in the outer band.

The compressive destructuring, dewatering, and dilution can all be implemented in one integrated piece of equipment immediately upstream of the primary refiner, and the fiberizing and fibrillating are both achieved between only one set of relatively rotating discs in the primary refiner.

The new, simplified TMP refining method, combining a destructuring pressurized screw discharger and fiberizing plates, was shown to effectively improve TMP pulp property versus energy relationships relative to known TMP pulping processes. The method improved the pulp property/energy relationships for at least the TMP and low retention/high pressure TMP refining systems. The low retention/high pressure refining systems typically operate between 75 psig and 95 psig, at either standard refiner disc speeds or higher disc speeds.

The defibration efficiency of the inner band improved at higher refining pressure. The level of defibration further increased with an increase in refiner disc speed.

Thermomechanical pulps produced with holdback outer bands had higher overall strength properties compared to pulps produced with expelling outer bands. The latter configuration required less energy to a given freeness and had lower shive content.

The specific energy savings to a given freeness using the inventive method in combination with expelling outer bands was 15% to 32% compared to the control TMP and low retention/higher pressure refining pulps.

In most cases the bar/grooves in the working region of the outer bands (fibrillation) must be finer than in the working region of the inner bands (defibration). To produce a mechanical pulp fiber, the fiber must first be defibrated (separated from the wood structure) and then fibrillated (stripping of fiber wall material). A key feature of this invention is that the working region of the inner bands primarily defibrates and the working region of the outer bands primarily fibrillates. A significant aspect of the novelty of the invention is maximizing the separation of these two mechanisms in a single machine and by that more effectively optimizing the fiber length and pulp property versus energy relationships. Since defibration in the inner bands takes place on relatively large destructured chips, the associated working region pattern of bars and grooves cannot be too fine. Otherwise the destructured chips would not adequately pass through the grooves of the inner bands and be distributed evenly. The defibrated material as received in the outer band feed region from the inner band and distributed to the outer band working region, is relatively smaller than that in the inner band feed region and thus the pattern of bars and grooves in the working region of the outer band is finer than in the inner band. Another benefit of the invention is that more even distribution (i.e., higher fiber coverage across refiner plates) occurs both in the inner bands and outer bands compared to conventional processes. Better feeding means better feed stability, which decreases refiner load swings, which in turn helps maintain more uniform pulp quality.

For compatibility with conventional TMP systems, the composite plates of the present invention can be modified to permit backflow of steam despite the tighter gap at the working region of the inner plate. In general, at least one of the confronting plates can include a steam backflow channel for directing some of the steam from the outer gap to the inner gap at the inner feed region or a location further upstream, while bypassing the inner gap at the inner working region.

An important benefit of the present invention is that it contributes to the minimization of the retention time at each functional step of the overall TMP process. This is possible because the fibrous material is sufficiently size reduced at each step in the process such that the operating pressures can almost instantaneously heat and soften the fiber to the required level. The process can be considered as having three functional steps: (1) producing destructured chips, (2) defibrating the destructured chips, and (3) fibrillating the defibrated material. The equipment configuration should establish minimum retention time from the macerating pressurized screw discharger discharge of step (1) to the refiner inlet. The refiner feed device (e.g., ribbon feeder or side entry feeder) operates almost instantaneously for initiating step (2) in the inner bands. The inner band design should establish a retention time for the material to pass through uninhibited. Some inner band designs may have longer residence than others to effectively defibrate, but the net retention time is still less than if fibration were performed in a separate component. The defibrated material passes almost instantaneously to the outer band where step (3) is achieved. Here also, the retention time is low. The actual retention time in the outer band will be dictated by the design of plates chosen to optimize pulp properties and energy consumption. The benefit of this very low retention (minimum) at each process step (while achieving necessary fiber softening for maintaining pulp strength properties) is maximum optical properties. A key feature of these plates includes an inner band for defibration and an outer band for fibration with a region of discontinuity between the bands such that a region of relaxation exists.

In the system described in International Application PCT/052003/022057, wherein the destructured chips were defibrated in a smaller fiberizer refiner before delivery to the main, primary refiner for fibrillation, the pressures were much lower in the fiberizing (defibration) step. The fiberizing retention time at pressure was much longer in a completely separate refiner. It was desirable to maintain a lower temperature to help preserve pulp brightness, since the low intensity refining intensity was gentle. High temperatures were therefore neither necessary nor desirable in the separate fiberizing refiner to preserve pulp strength. In the present invention, defibration and fibrillation are performed within the same highly pressurized refiner casing. The refining intensity in the fiberizing (defibrating) inner band is still low, achieved at high pressure and a low retention time. There is no negative impact on brightness despite the high pressure (temperature), because the retention time is so short. This is analogous to the surprisingly beneficial effect of low preheat retention time at high temperature as described in U.S. Pat. No. 5,776,305.

When the present invention is implemented in a low retention/high pressure refining system, there is no need for a separate preheat conveyor immediately upstream of the refiner feed device, because the destructured chips heat up rapidly during normal conveyance from the plug screw discharger to the refiner. The environment from the expansion volume or chamber to the rotating discs is the refiner operating pressure, e.g., 75 to 95 psig, and the "retention time" at the corresponding saturation temperature during conveyance between the plug screw discharger and refiner is well under 10 seconds, preferably in the range of 2-5 seconds, corresponding to the preferred low retention/high pressure refining preheat retention time.

More generally, the process advantage of achieving energy efficient production of quality TMP pulp with minimum time at each process step can be achieved in a wide variety of refiner systems, and has the corollary advantage of minimizing the component, space, and cost requirements of equipment for implementing the process. The dual band geometry with discontinuity region for the refiner plates according to one aspect of the invention can be used for various flat plate types not limited to but including single direction flat, counter-rotating, two-in-one-refiners, and double disc refiners.

DESCRIPTION OF THE PREFERRED EMBODIMENTS

1. Overview

Figure 1:
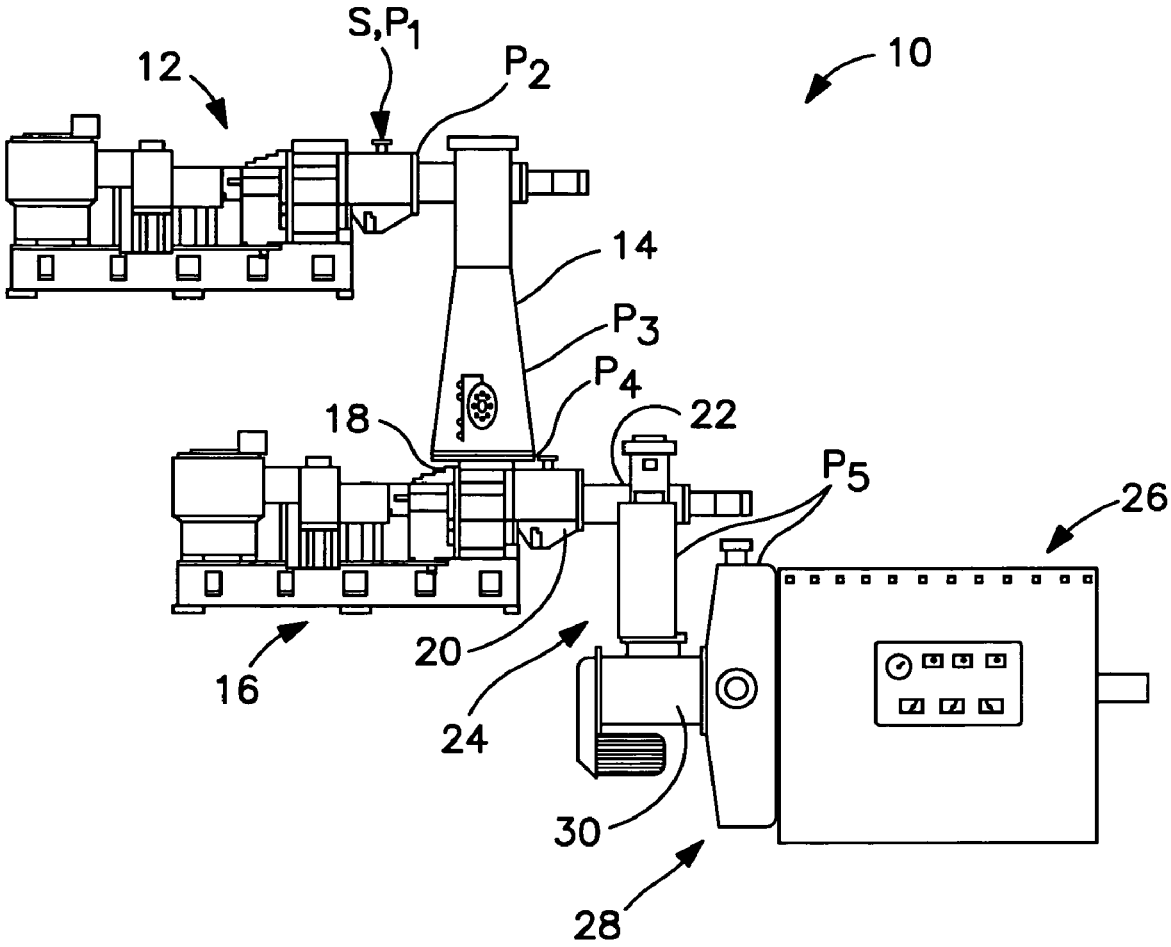
FIG. 1 is a schematic of a TMP refiner system that illustrates an embodiment of the invention.

FIG. 1 shows a TMP refiner system 10 according to the preferred embodiment of the invention. A standard atmospheric inlet plug screw feeder 12 receives presteamed (softened) chips from source S at atmospheric pressure $P_1$=0 psig and delivers pre-steamed wood chips at pressure $P_2$=0 psig to a steam tube 14 where the chips are exposed to an environment of saturated steam at a pressure $P_3$. Depending on the system configuration, the pressure $P_3$ can range from atmospheric to about 15 psig or from 15 to up to about 25 psig with holding times in the range of a few seconds to many minutes. The chips are delivered to a macerating pressurized plug screw discharger 16.

The macerating pressurized plug screw discharger 16 has an inlet end 18 at a pressure $P_4$ in the range of about 5 to 25 psig, for receiving the steamed chips. Preferably, the macerating pressurized screw discharger has an inlet pressure $P_4$ that is the same as the pressure $P_3$ in the steam tube 14. The macerating pressurized screw discharger has a working section 20 for subjecting the chips to dewatering and maceration under high mechanical compression forces in an environment of saturated steam, and a discharge end 22 where the macerated, dewatered and compressed chips are discharged as conditioned chips into an expansion zone or chamber at pressure $P_5$ where the conditioned chips expand. Nozzles or similar means are provided for introducing impregnation liquid and dilution water into the discharge end of the screw device, whereby the dilution water penetrates the expanding chips and together with the chips forms a refiner feed material in feed tube 24 having a solids consistency in the range of about 30 to 55 percent. Alternatively, especially if no impregnation apart from dilution is required, the dilution can be achieved in a dilution chamber that is connected to but not necessarily integral with the macerating screw discharge. In this context, maceration or destructuring of the chips means that axial fiber separation exceeds about 20 percent, but there is no fibrillation.

A high consistency primary refiner 26 has relatively rotating discs in casing 28 that is maintained at pressure $P_5$, each disc having a working plate thereon, the working plates being arranged in confronting coaxial relation thereby defining a space which extends substantially radially outward from the inner diameter of the discs to the outer diameter of the discs. Each plate has a radially inner band and a radially outer band, each band having a pattern of alternating bars and grooves. The pattern on the inner band has relatively larger bars and grooves and the pattern on the outer band has relatively smaller bars and grooves. A refiner feed device 30, such as a ribbon feeder, receives the feed material from the dilution region associated with the macerating pressurized screw discharger (directly or via an intermediate buffer bin) and delivers the material at pressure $P_5$ to the space between the discs at substantially the inner diameter of the discs. As will be described in greater detail below, the inner band completes the fiberizing (defibration) of the chip material and the outer band fibrillates the fibers.

The system may be backfit into typical TMP or low retention/high pressure refining system. This range of process or component conditions can be summarized in the following table:

Range of System Conditions Within Scope of the Invention

| COMPONENT CONDITIONS | RANGE | PREFERED |
|---|---|---|
| Pressure P1@ chip source S | 0 psig | 0 psig |
| Pressure P2 @ 12 outlet | 0-30 psig | 0-30 psig |
| Pressure P3 @ steam tube 14 | 0-30 psig | 0-30 psig |
| Holding time steam tube 14 | 10-180 sec | 10-40 sec |
| Inlet pressure P4 @ 16 | 0-30 psig | 0-30 psig |
| Processing time in 16 | <15 sec | <15 sec |
| Pressure P5 @ expansion volume 22, refiner feeder 30 and casing 28 | 30-95 psig | 75-95 psig |
| Dwell time in expansion volume 22 refiner feeder 30 and casing 28 | <10 sec | <10 sec |

Figure 2A:
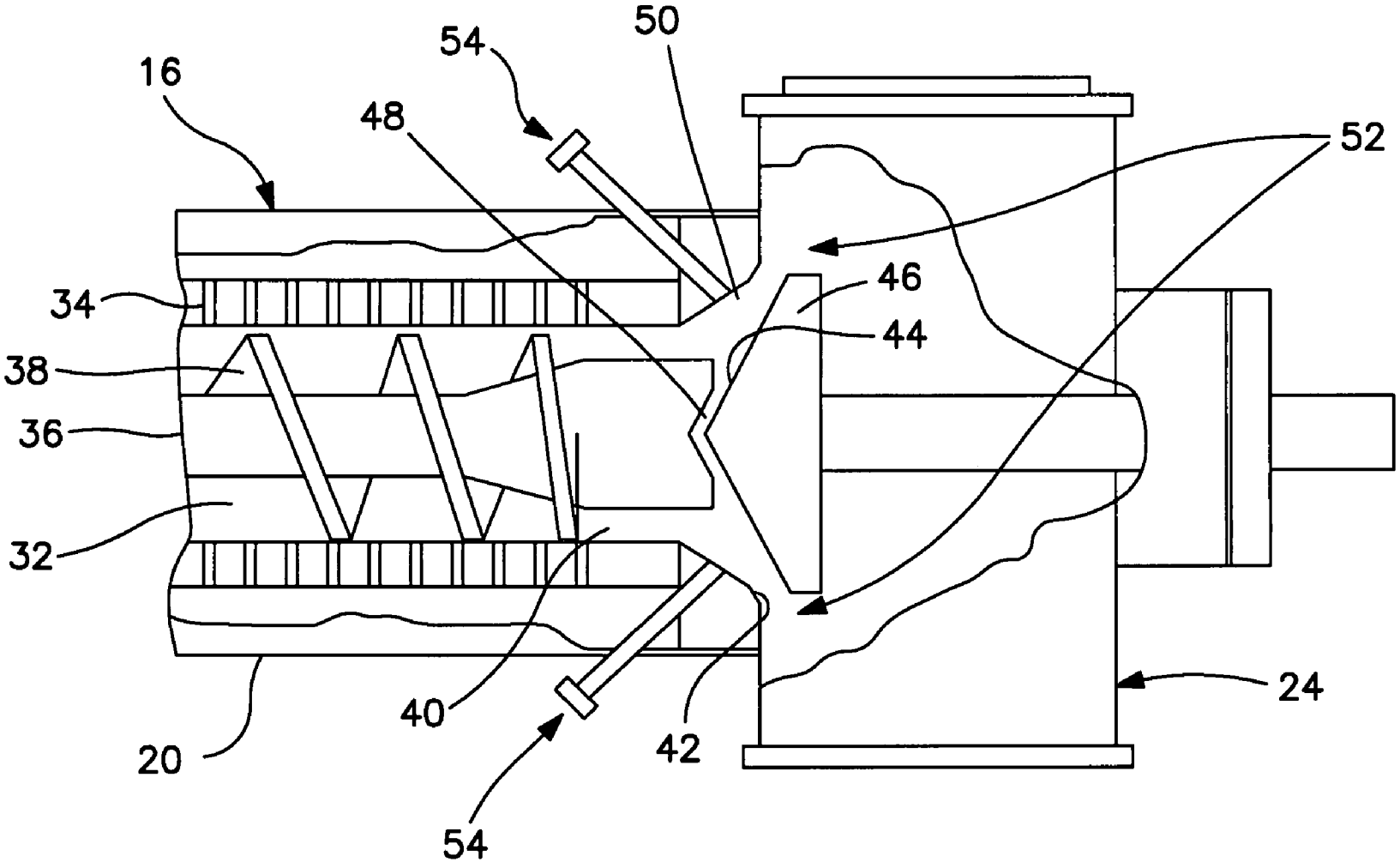
FIGS. 2A and B are schematics of alternatives of a macerating pressurized screw with dilution injection feature, suitable for use with the present invention.

FIGS. 2A and B are schematics of a macerating pressurized screw 16 with dilution injection feature, suitable for use with the present invention. According to the embodiment of FIG. 2A, chip material 32 is shown in the central, dewatering portion of working section 20, where the diameters of the perforated tubular wall 34, rotatable coaxial shaft 36, and flights 38 are constant. A chip plug 40 is formed in the plug portion of the working section, immediately following the dewatering portion, where the wall is imperforate and the shaft has no flights but the shaft diameter increases substantially, producing a narrowed flow cross section and thus a high back pressure that enhances the extrusion of liquid from the chips, through the drain holes formed in the wall of the central portion. The constricted flow and macerating effect may be further enhanced or adjusted by use of a tubular constriction insert (not shown) within the imperforate wall, or rigid pins or the like (not shown) projecting from the wall into the plugged material. The plug is highly compressed under mechanical pressures typically in the range of 1000 psi to 3000 psi, or higher. Most if not all of the maceration occurs in the plug. The chips are substantially fully destructured, with partial defibration exceeding about 20 percent usually approaching 30 percent or more.

At the end of the plug, the discharge end 22 of the macerating pressurized screw discharger has an increased cross sectional area, defined between an outwardly flared wall 42 and the confronting, spaced conical surface 44 of the blow back valve. 46. The blow back valve is axially adjustable from a stop position nested in a conical recess 48 at the end of the macerating pressurized screw discharger shaft 36, to a maximum retracted position. This adjusts the flow area of the expansion zone or volume 50 while maintaining a mild degree of sealing at 52 by chip material between the valve against the outer end of the flared wall, which can be controlled in response to transient pressure differential between the feed tube 24 and the macerating pressurized screw discharger 16.

In the expansion zone 50, impregnating liquor is fed under high pressure either through a plurality of pressure hoses 54 and associated nozzles (as shown), or a pressurized circular ring. The dewatered chips entering the expansion zone 50 quickly absorb the impregnation fluid and expand, helping to form the weak sealing zone at the end of the expansion zone.

Figure 2B:
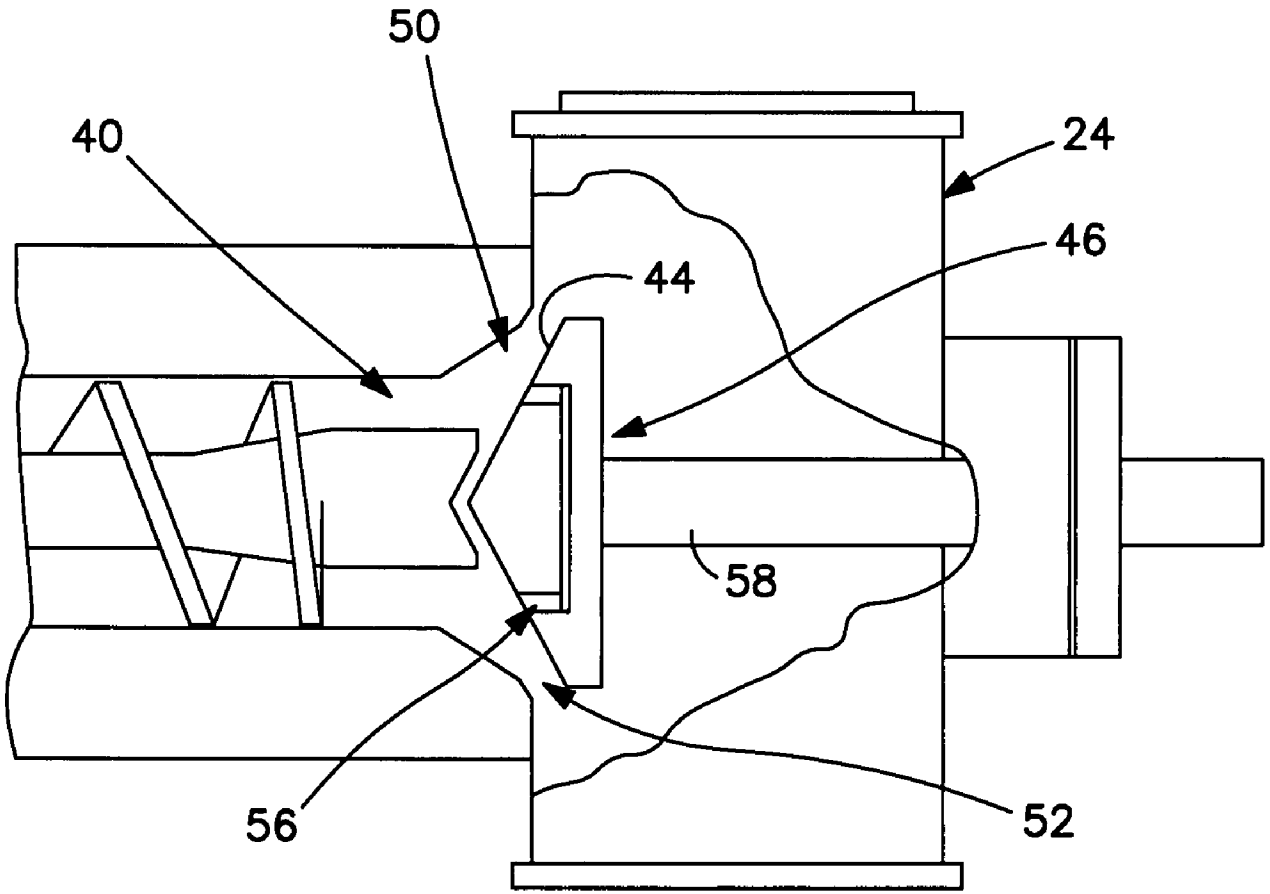

FIG. 2B shows an alternative whereby the impregnation in the expansion zone 50 is achieved by providing fluid flow openings 56 in the face of the conical blow back valve, which can be supplied via high pressure hoses through the shaft 58 of the blow back valve.

The feed tube 24 is preferably a vertical drop tube for directing and mixing the diluted chips from the macerating pressurized screw discharger 16 to the feed device 30 of the refiner. However, it should be understood that the pressure $P_5$ in the feed tube 24 is the same pressure as in the feed device 30 and refiner casing 28. A small pressure boost or drop may be desired between the refiner feed device 30 and refiner casing 28, which is common practice in the field of TMP. Regardless, the pressures throughout this region following the macerating pressurized screw discharger to the refiner casing would typically be well above 30 psig, usually above 45 psig, which is much higher than the macerating pressurized screw discharger inlet steam pressure $P_4$. However, the plug 40 is so highly mechanically compressed that even with the tube pressure as high as 95 psig or more, the compressed plug will quickly expand in the expansion zone due to the expansion of pores in the fibers in the uncompressed state. It can thus be appreciated that the feed tube can act as an expansion chamber in contributing to the effectiveness of the expansion volume. Practitioners in this field could readily modify the design and relationship of the expansion zone and feed tube so that expansion and dilution occur predominantly in a dedicated expansion chamber that is attached to but not integral with the macerating pressurized screw discharger.

As an example but not a limitation, the consistency in the plug-pipe zone is typically in the range of 58%-65%, and in the expansion zone with impregnation/dilution, in the range of about 30%-55%. The goal is to target the optimum refining consistency, usually around 35%-55%, as delivered to the refiner feed device for introduction between the refiner plates.

Figure 3:
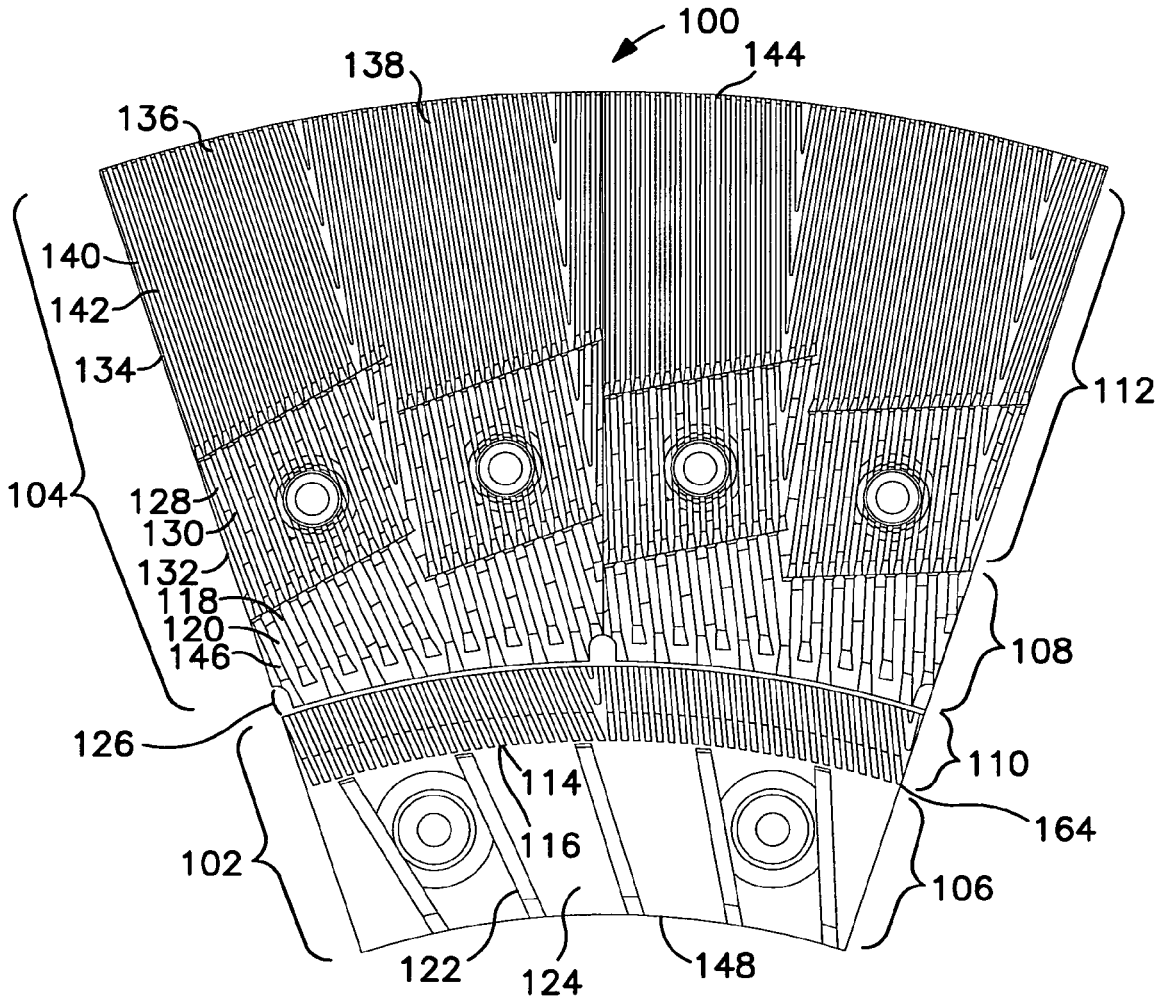
FIG. 3 is a schematic representation of a portion of a refiner disc plate, showing the inner fiberizer band and the distinct outer fibrillation band.

FIG. 3 is a schematic representation of a portion of a refiner disc plate 100, showing the inner fiberizer band 102 and the outer fibrillation band 104. Each band can be a distinct plate member attachable to the disc, or the bands can be integrally formed on a common base that is attachable to a disc. Each band has an inner feeding region 106, 108 and an outer working region 110, 112. The working (defibrating) region of the inner band is defined by a first pattern of alternating bars 114 and grooves 116, and the feeding region of the outer band is defined by a second pattern of alternating bars 118 and grooves 120. The very coarse bars 122 and grooves 124 in the feeder region 106 of the inner band direct the previously destructured chip material into the defibrating region 110 of significantly narrower bars and grooves. The fiberized material then intermixes in and crosses the transition annulus 126, where it enters the feed region 108 of the outer band. In general, the first pattern on the working region 110 on the inner band has relatively narrower grooves than the grooves of the second pattern on the feeding region 108 on the outer band. The working (fibrillating) region 112 of the outer band has a pattern of bars 128 and grooves 130 wherein the grooves 130 are narrower than the grooves 116 of the working region 110 of the inner band.

The coarse bars and grooves of the feeding region 106 of the inner band on one disc can be juxtaposed with a feeding region on the opposed disc that has no bars and grooves, so long as the shape of the feed flow path readily directs the feed material from the ribbon feeding device into the working regions 110 of the opposed inner bands. Thus, every inner band 102 will have an outer, fiberizing region 110 with a pattern of alternating bars and grooves 114, 116 but the associated inner region 106 will not necessarily have a pattern of bars and grooves. The outer region 112 of the fibrillating band 104 can have a plurality of radially sequenced zones, such as 132, 134, and/or a plurality of differing but laterally alternating fields, in a manner that is well known for the "refining zone" in TMP refiners, such as 136, 138. In FIG. 3, the outer band 104 has an inner, feeding region 108 of alternating bars and grooves, and the working region 112 has a first pattern of alternating bars and grooves 128,130 appearing as laterally repeating trapezoids in zone 132, and another pattern of alternating bars and grooves 140, 142 appearing as laterally repeating trapezoids in zone 134 that extend to the circumference 144 of the plate.

The annular space 126 between the inner and outer bands 102, 104 can be totally clear, or as shown in FIG. 3, some of the bars such as 146 in the outer band feed region 108 can extend into the annular space. The annular space 126 delineates the radial dimension of the inner and outer bands, whereby the radial width of the inner band 102 is less than the radial width of the outer band 104, preferably less than about 35 percent of the total radius of the plate from the inner edge 148 of the inner band 102 to the circumferential edge 144 of the outer band 104. Also, the radial width of the feed region 106 of the inner band 102 is larger than the radial width of the working region 110 of the inner band, whereas the radial width of the feed region 108 in the outer band 104 is less than the radial width of the working region 112.

The destructured and partially defibrated chip material enters the inner feed region 106 where no substantial further defibration occurs, but the material is fed into the working region 110 where energy-efficient low intensity action of the bars and grooves 114, 116 defibrates substantially all of the material. Such plates can be beneficially used as replacement plates in refiner systems that may not have an associated pressurized macerating discharger. Where a pressurized macerating screw discharger is present, the combination of full destructuring and partial defibration along with high heat upstream of the refiner allows the plate designer to minimize the radial width and energy usage in the working region 110 of the inner band for completing defibration. The pattern of bars and grooves 114, 116 and the width of the working region 110 can be varied as to intensity and retention time. Even with less than ideal upstream destructuring and partial defibration, the plate designer can increase the radial width of the inner working zone 110 and chose a pattern that retains the material somewhat for enhanced working, while still achieving satisfactory fibrillation in a shortened high intensity outer band 112 and overall energy savings for a given quality of primary pulp.

Figure 4A:
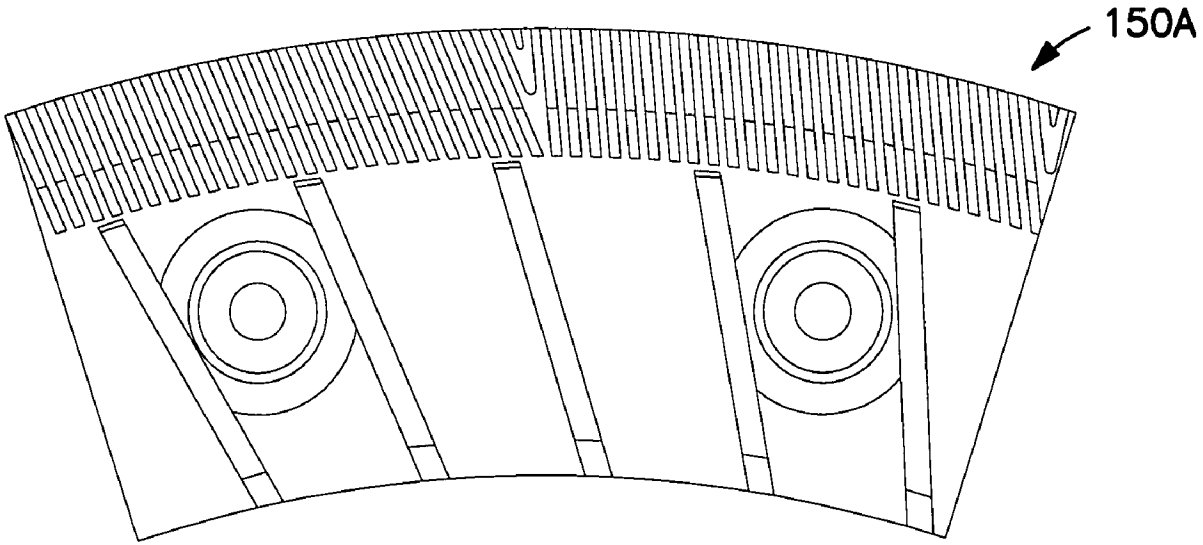
FIGS. 4 A and B show an exemplary inner, fiberizing band pair for the rotor and stator, respectively, having angled bars and grooves.
Figure 4B:
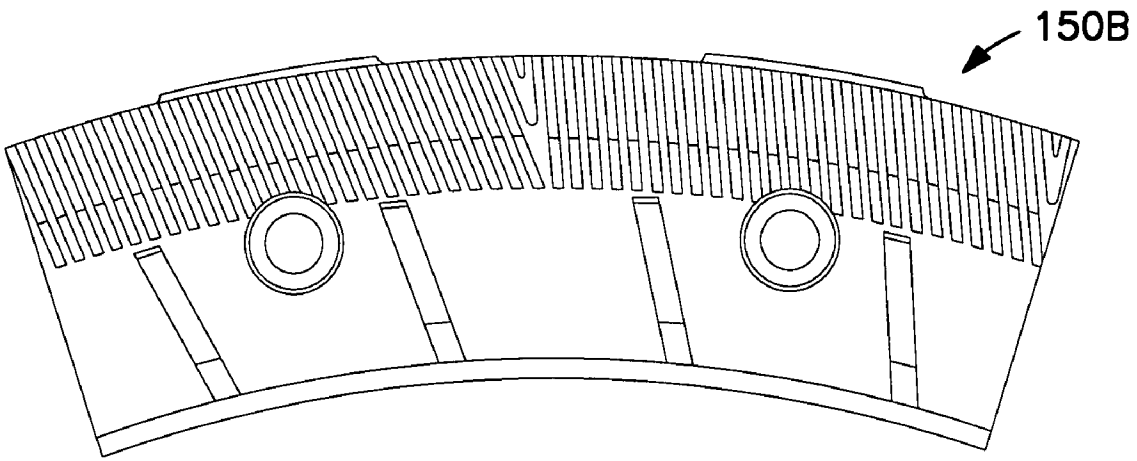
Figure 5:
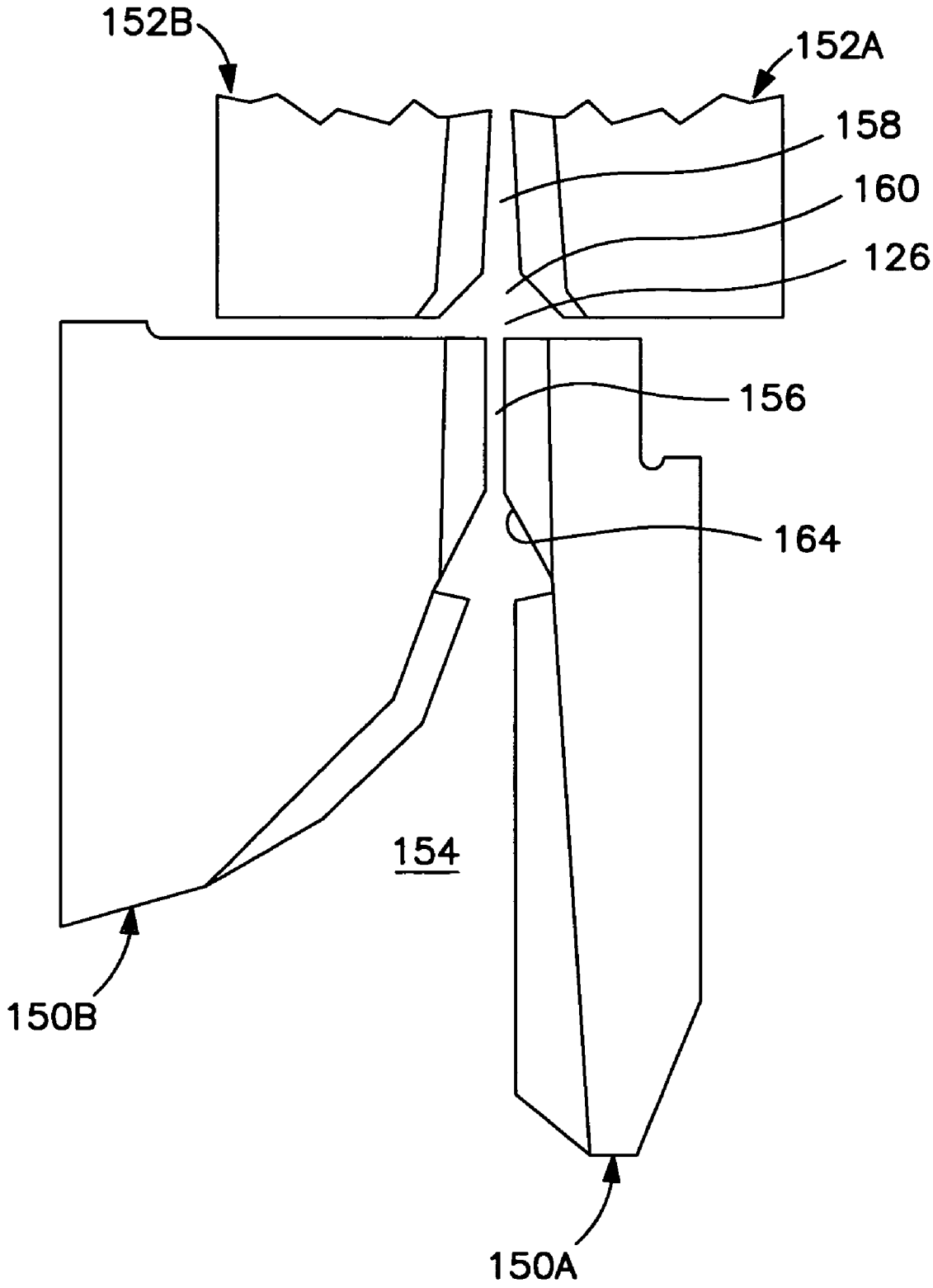
FIG. 5 shows the relationship of the inner, fiberizing band pair to the outer, fibrillation band pair, at the transition region.
Figure 6A:
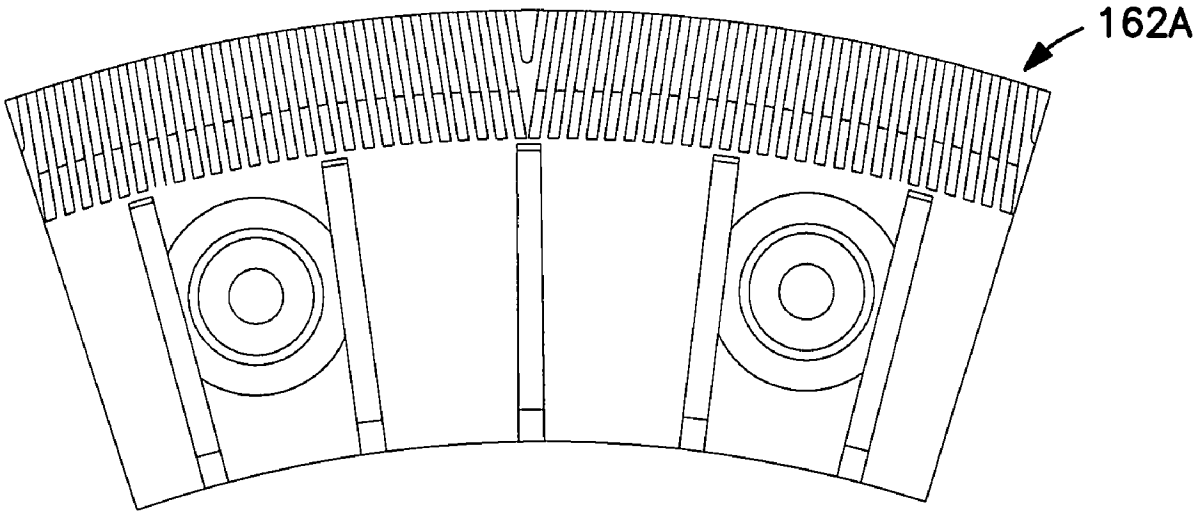
FIGS. 6 A and B show another exemplary fiberizing band pair, having substantially radial bars and grooves.
Figure 6B:
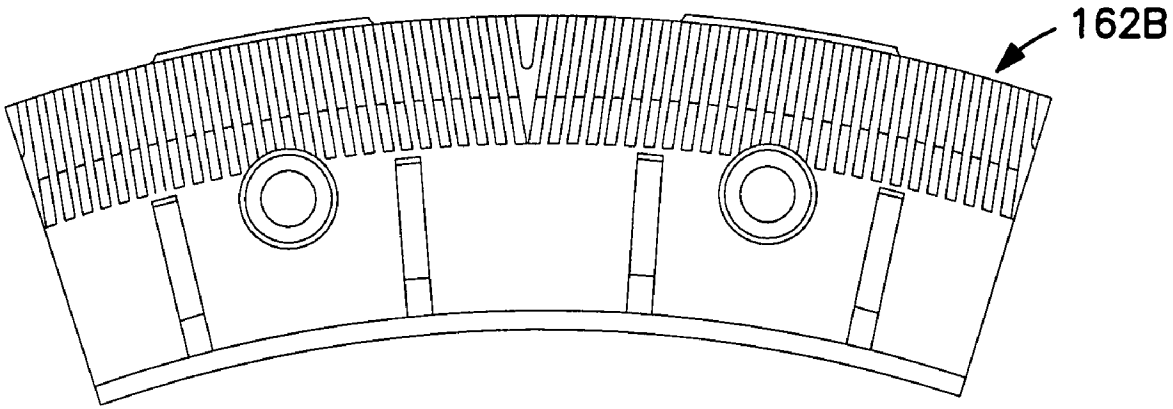
Figure 7C:
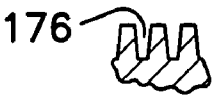
FIGS. 7A and B show an exemplary outer, fibrillating band, in front and side views, respectively, and FIGS. 7C and D show section views across the bars and grooves in the outer and middle zones, respectively.
Figure 7D:
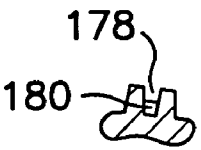
Figure 7A:
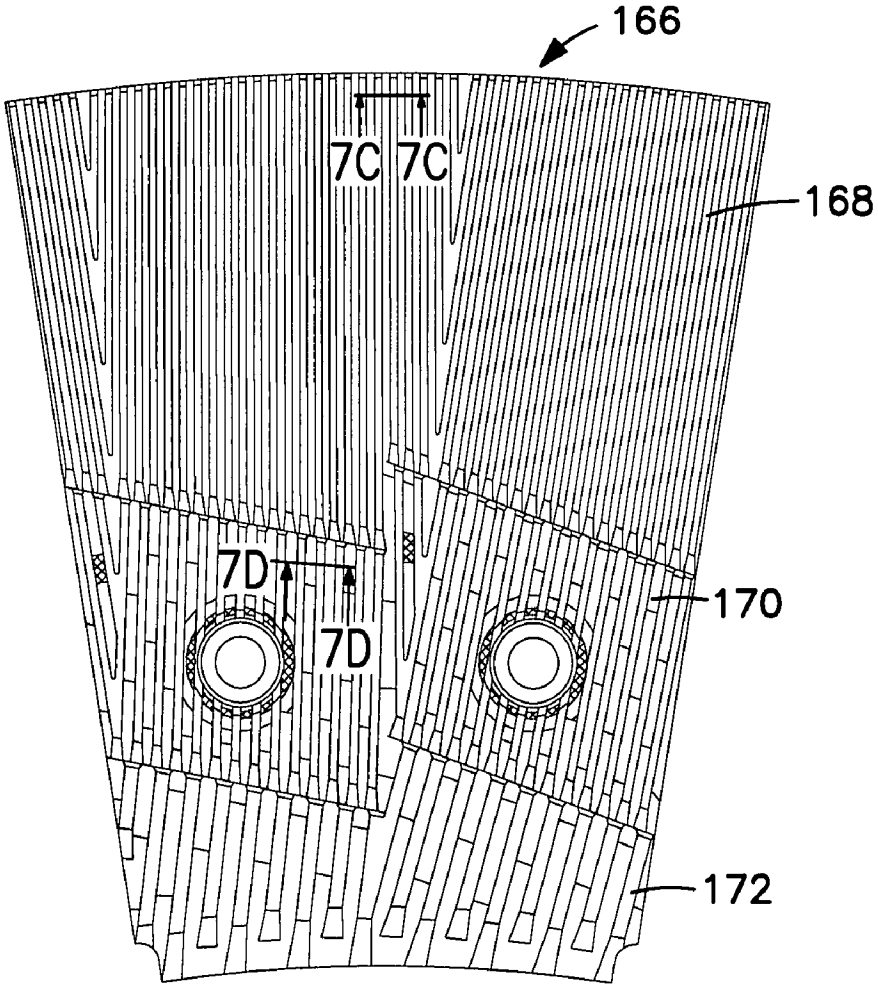
Figure 7B:
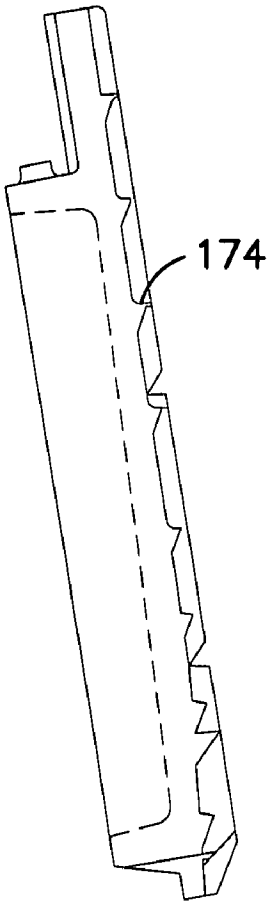

The composite plate shown in FIG. 3 is merely representative. FIGS. 4 and 6 show other possible regions for the inner bands. FIG. 4A shows one inner band 150A and FIG. 4B shows the opposed inner band 150B. FIG. 5 shows a schematic juxtaposition of opposed inner bands 150A and 150B, with portions of the associated outer bands 152A and 152B as installed in the refiner. The feed gap 154 of the inner bands is preferably curved to redirect the feed material received at the "eye" of the discs from the axially conveyed direction, toward the radial working gap 156 of the inner bands. Preferably, the feeder bars (very coarse bars) are spaced apart by more than the size of the material in the feed. For example, the smallest of the three dimensions defining the chips (chip thickness) is typically 3-5 mm. This is to avoid severe impact, which results in fiber damage in the wood matrix. In most instances, the minimum gap 154 during operation should be 5 mm. The coarse feeder bars have the sole function of supplying the outer part of the inner band with adequate feed distribution and should do no work on the chips. The feeder bars are provided on the rotor inner band, but are not absolutely necessary on the stator inner band.

It should be appreciated that the geometry of a conventional plate used in a flat disc refiner has a radius from the inner to the outer edge of the plate. Two flat plates form an opposed pair when mounted in the refiner, each having a working face including a pattern of raised and relief structure (e.g., bars, grooves, recesses), which when viewed transversely to the axis such as in FIG. 5, establish a radially extending refining gap between the plates. This gap has a profile that varies from the inner to the outer radius of the plates. The gap, and thus the gap profile, is defined by the dimension between the top surfaces of the opposed raised structures (bars) and directly affects the flow area available for the material as it travels radially between the plates. At any radial position, the total flow area also includes the cross sectional area of any recesses or the grooves between the bars. The overall change in flow area, including the gap, between conventional flat disc plates can be expressed as $dA/dr<0$ over the entire radial distance $R_i$ at the inner edge to $R_o$ at the outer edge of the plate.

With the present invention, the rate of change of the flow area can be expressed as:

$dA/dr<0$ from $R_i$ to $R_a$ $dA/dr>0$ from $R_a$ to $R_b$ $dA/dr<0$ from $R_b$ to $R_o$ where $R_i<R_a<R_b<R_o$.

The increasing area between $R_a$ and $R_b$ can be viewed as a discontinuity or relaxation volume, between or at the transition of the inner and outer bands at the feed region of the outer band. The material that was defribrated in the working region of the inner band enters the relaxation volume where the material is mixed and distributed by the feed bars and grooves in the feeding region of the outer band.

The gap profile as viewed in FIG. 5, has a conveying inner feed portion 154 followed by an inner working region gap 156 that preferably radially converges to an inner minimum gap that can extend radially at a substantially uniform gap. After converging at a rate of 10% to 30% over a distance of up to about one inch, the working region gap reaches a minimum in the range of about 1.5-3.0 mm, preferably about 2.0 mm. The groove width in this working region is less than about 4.0 mm, preferably no greater than about 3.0 mm. The groove orientation preferably promotes outward pumping of the material as it is defibrated. A discontinuous transition portion 160 follows, with an abrupt increase in the gap to greater than about 4.0 mm, associated with the feed region of the outer band. This can converge through the feed region and is followed by an outer working portion that radially converges to an outer minimum fibrillation gap in the range of 0.5-1.0 mm. The gap has a radially extending, straight center from the entrance to the inner working region to the exit of the outer working region.

The inner feed portion of the gap includes a coarse face structure comprising a coarse pattern of feeder bars and grooves, whereas the inner working portion comprises a relatively finer, defribrating pattern, of bars and grooves. The transition portion, where the discontinuity or relaxation effect is achieved, can include another coarse, feeder pattern of bars and grooves, whereas the outer working portion comprises a relatively finer, fibrillating pattern of bars and grooves. In most implementations, the grooves in the working region of the inner band would be smaller than the grooves in the feeding region of the outer band. The grooves in the working region of the inner band would be larger than the grooves in the working region of the outer band. Overall, the intensity experienced by the material in the working region of the inner band is lower than the intensity experienced by the working material in the working region of the outer band.

It should be appreciated that the flow area increases at the transition can be achieved by a combination of changes in the gap and groove widths. If the gap increase is large, the feed region of the outer band is not necessarily coarser than the working region of the inner band. The relaxation material flow area increase $dA/dr>0$ comes immediately after the minimum gap width of the defibration region (where the area A is also at a minimum in the defibration region). The relaxation area increase can be established by any one or more of (a) opposed smooth annular recess on both plates, situated radially between the inner and outer bands; (b) smooth annular recess on one plate and opposed coarse and/or chamfered lead ins of some of the outer feeder bars on the opposed plate (shown in FIGS. 8 D and E), (c) annular configuration on each opposed plate, with lead ins of some of the outer feeder bars (shown in FIG. 7), and (d) no annular configuration, but coarse feeder bars with or without chamfer or fine feeder bars with lead in chamfer on all feeder bars.

In the embodiment of FIG. 4, the bars and grooves in the inner band are angled relative to the radius, thereby inhibiting free centrifugal flow in the inner band and increasing retention time, if rotated to the left, or accelerating the flow if rotated to the right. In the embodiment of FIG. 6, inner bands 162A and 162B have a substantially radial orientation that neither inhibits or nor enhances centrifugal flow.

As shown in FIGS. 3 and 5, the bars at the inlet of the defibrating region, e.g. the outer region of the inner bands, have a long chamfer 164, or a gradual wedge closing shape. In general, the entrance to the fiberizing gap 156 between the inner bands is radial or near radial (no significantly scattered transition). This also prevents strong impacts on the wood chips. The slope of the chamfer should be typically a drop of 5 mm in height over a radial distance of 15-50 mm. The resulting slope is 1:5 to 1:10, but slopes of 1:3-1:15 with height drop of 3 to 10 mm are acceptable. It is that wedge shape that defines the low intensity "peeling" of chips, as opposed to the high intensity impacts of conventional breaker bars operating at a tight gap. The operating gap 156 in the working region of the inner plate can narrow gently outwardly, for a distance of up to 3 inches or more. If the chamfer 164 is in the lower range of the angle (e.g. 1:3), then a large taper of gap 156 should be used, e.g., at least 1:40. This will ease the feed into the tighter gap. The outer part of the inner band is preferably ground with taper, which ranges from flat to approximately 2 degrees, depending on application. Larger tapers and larger operating gaps will reduce the amount of work done in the inner bands. The construction of the outer region of the inner band is such that it should minimize impact on the feed material in order to preserve fiber length at a maximum, while properly separating fibers.

The groove width in the fibrating region 110 should be smaller than the wood particles, preferably about the minimum operating gap for the fibrating region. Typically, no groove should be wider than 4 mm. This ensures that wood particles are being treated in the gap rather than being wedged between bars and hit by bars from opposing disc.

In the fibrating inner region 110, the chips are reduced to fibers and fiber bundles before passing through annular space 126 and entering the outer band 104 at 160. That band can closely resemble known high consistency refiner plate construction. As the fibers are mostly separated, they will not be subjected to high intensity impacts. One can see from FIGS. 3 and 5 that if untreated chips could enter the feeder region 108 of the outer band, they would be subjected to high intensity impacts when the chip is wedged between two coarse bars 118, 120. If the chips are properly separated in the fibrator inner bands 102, then there are no large particles left, so they cannot be subjected to this type of action.

The inlet of the outer region of inner band has a radial transition, or close to radial (i.e., arcuate of substantially constant radius as viewed face-on). Large variation in the radial location of the start of the ground surface normally results in the loss of fiber length, when particles larger than the gap are quickly forced into the gap. With a long chamfer at the start of the region (longer is better), the material fed will be gradually reduced in size until small enough (coarseness reduction) to enter the gap formed by the working surfaces (not shown in FIG. 5). Subsurface dams or surface dams can be used in order to increase the efficiency of the action and/or increase energy input in the inner plates.

The division of functionality as between the inner and outer bands can also be implemented in a so-called "conical disc", which has a flat initial refining zone, followed by a conical refining zone within the same refiner. In that case, the inventive fibrating bands would substitute for the flat refining zone, which would then be followed by the conventional "main plate" refining in the conical portion. Normally, a conical portion for such refiners has a 30 or 45 degree angle cone, e.g. it is 15 or 22.5 degrees from a cylindrical surface. An example of such a conical disc refiner is described in U.S. Pat. No. 4,283,016, issued Aug. 11, 1981. Thus, as used herein, "disc" includes "conical disc" and "substantially radially" includes the generally outwardly directed but angled gap of a conical refiner. The term "flat disc" is used in distinction, where the disc and/or plate is substantially flat over the entire working surface, as in the accompanying drawings.

Two embodiments of the outer, fibrillating band are shown in FIGS. 7 and 8. These can range from high intensity to very low intensity. For the purpose of illustration of the concept, the pattern of FIG. 7 is a typical example of a high intensity directional outer band 166. FIG. 8 represents a very low intensity bi-directional design 182. Various other bar/groove configurations can be used, such as having a variable pitch (see U.S. Pat. No. 5,893,525).

The directional band 166 is coarser and has a forward feeding region 172 which reduces retention time and energy input capability in that area, forcing more energy to be applied in the outer part of the band, which in turn increases the intensity of the work applied there, and thus will operate at a tighter gap. The working region of the outer band has two zones 168,170, the outer 168 of which has finer grooves than the former 170. Some or all of the grooves such as 176 in the zone 168 can define clear channels that are slightly angle to the true radii of the band, whereas other grooves such as 180 in the other zone 170 can have surface or subsurface dams 174, 178. Overall, the outer band 166 is similar to the outer band 112 of FIG. 3.

As another example, the full-length variable pitch pattern 182 of FIG. 8 has essentially radial channels, without any centrifugal feeding angle. The feed region 190 is very short, and the working region 188 can have uniform or alternating groove width, or as shown at 184 and 186, alternating or variable groove depth. This allows for a longer retention time within the plates and, combined with the large number of bar crossings, allows for a low intensity of energy transfer, which results in a larger plate gap.

Figure 8C:
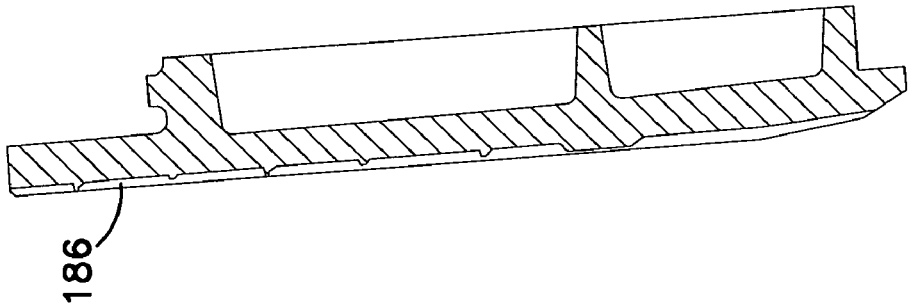
FIGS. 8A, B and C show another exemplary outer, fibrillating band in front and section views, respectively.
FIG. 8D shows a side and front view, respectively, of an exemplary outer band for a rotor disc, having curved feeding bars.
FIG. 8E shows a side and front view, respectively, of an exemplary opposing outer band for a stator, to be employed with the outer band of FIG. 8D.
Figure 8B:
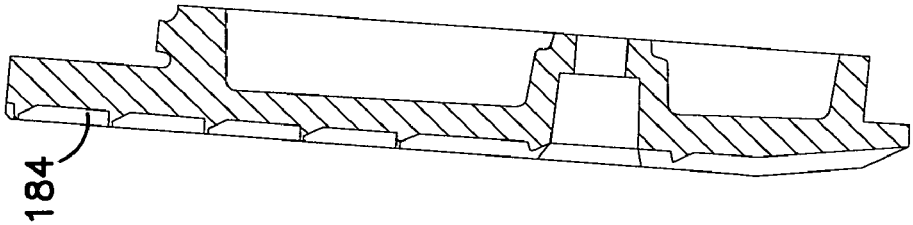
Figure 8A:
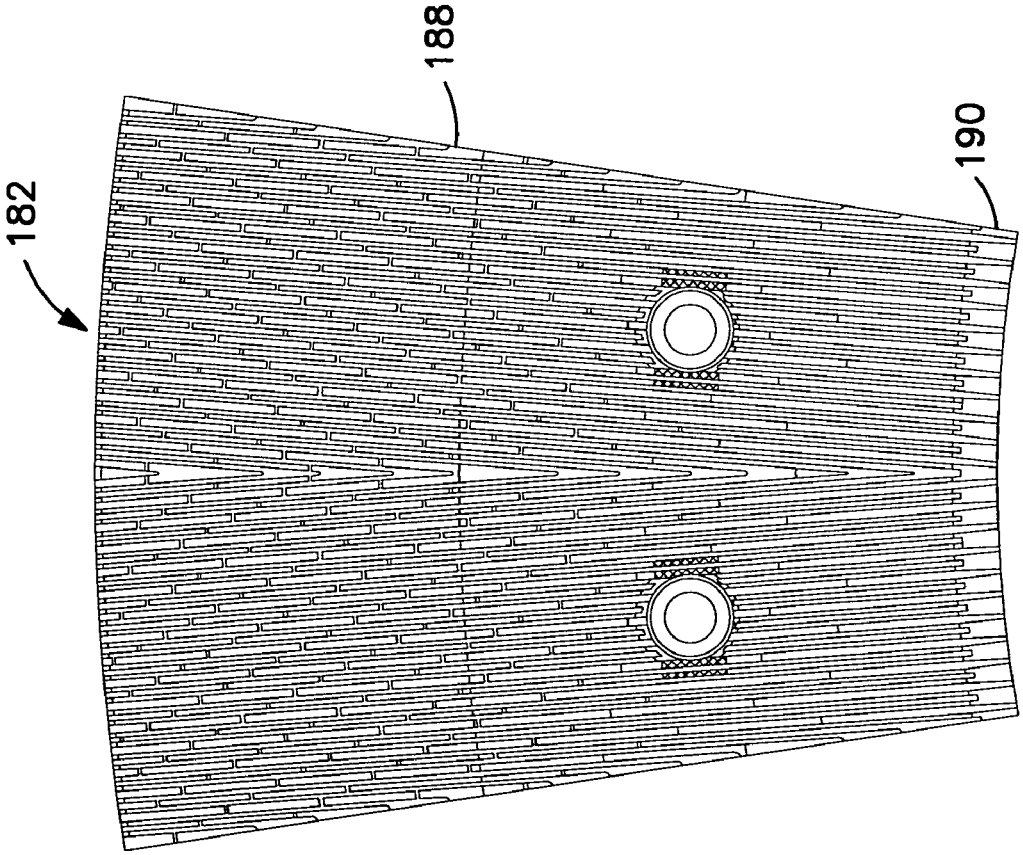
Figure 8D:
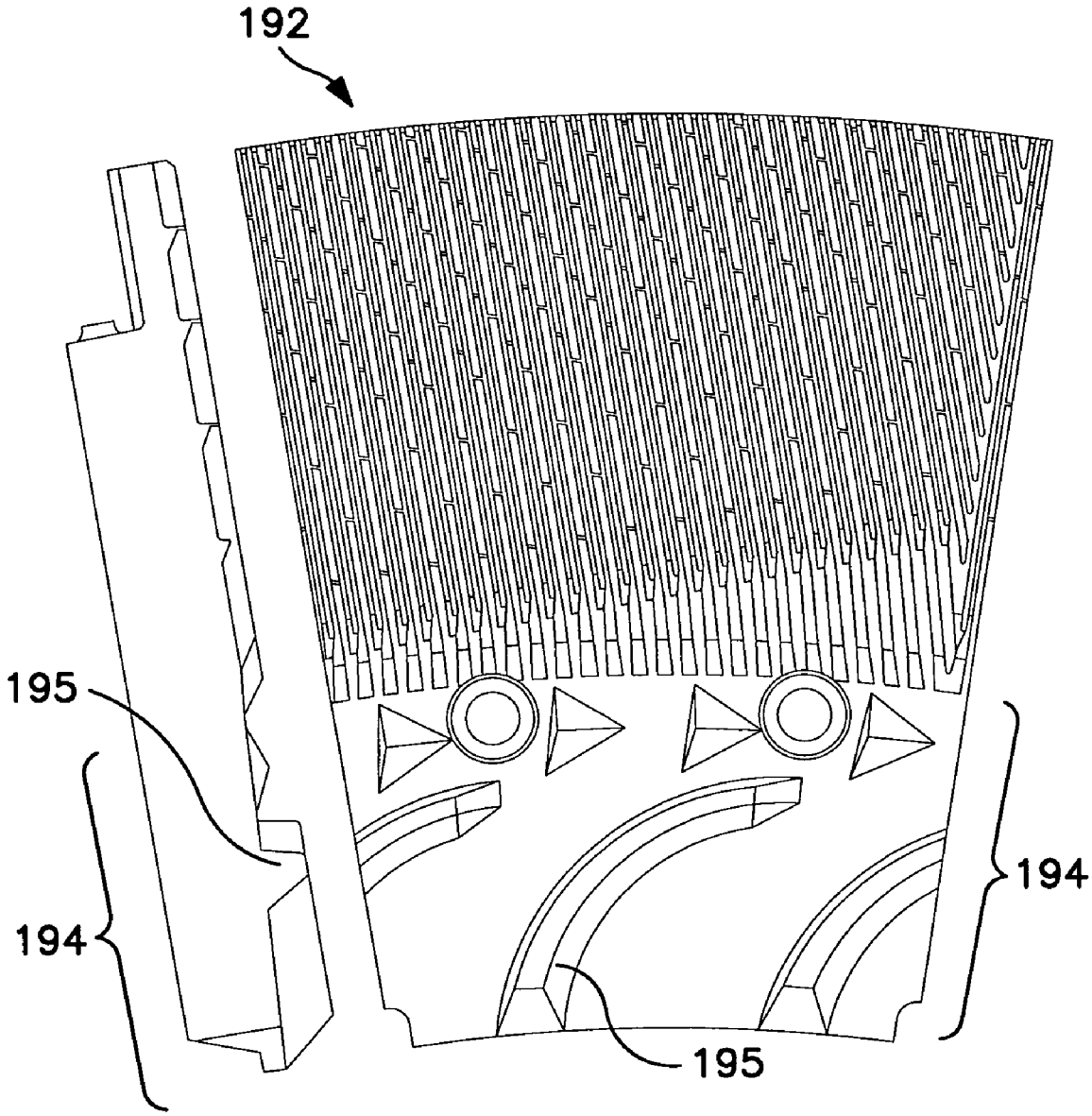
Figure 8E:
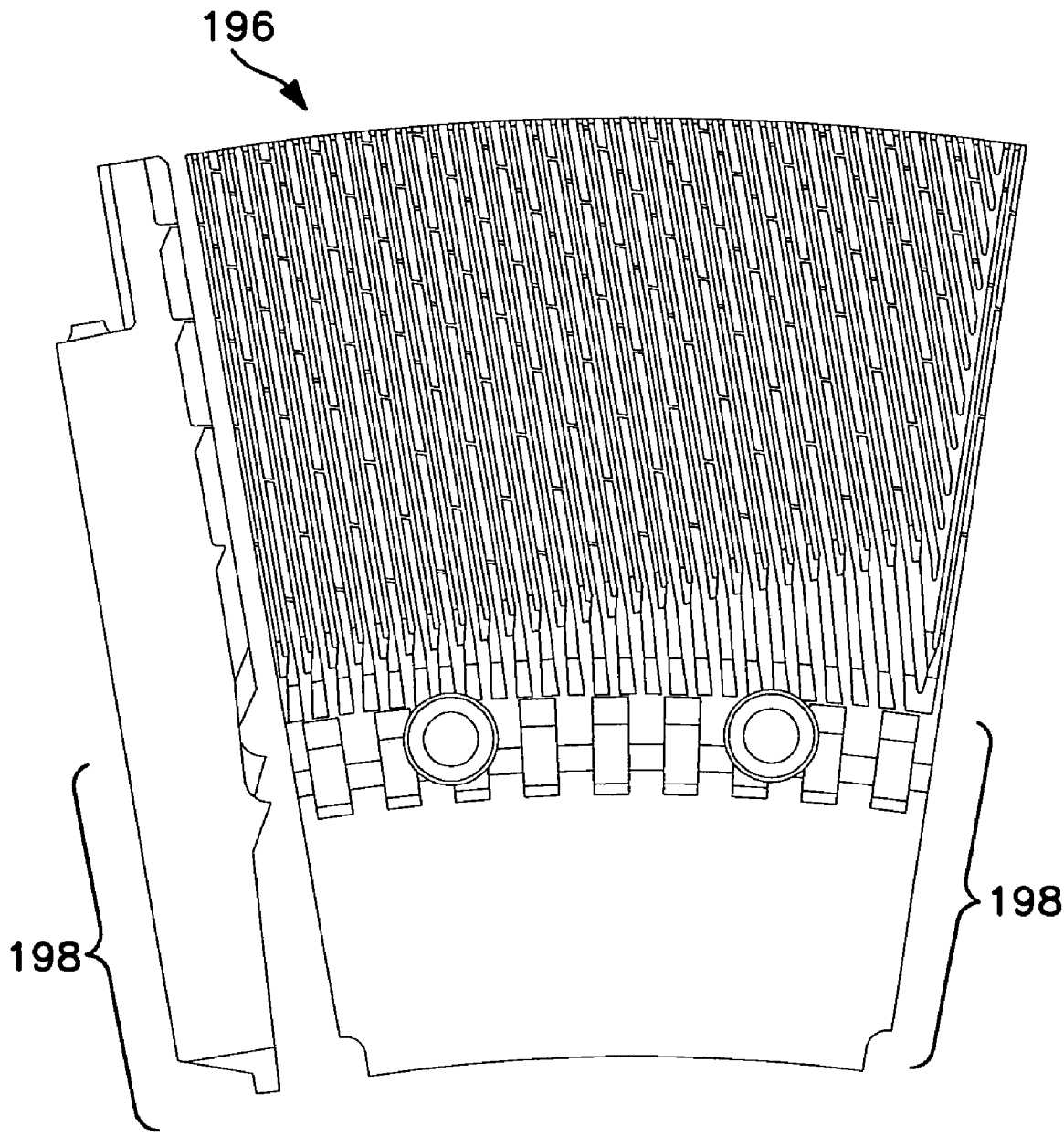

In a variation of the outer band, the inner feeding region of the outer band is designed to prevent backflow of fiber from the outer band to the inner band. FIG. 8D presents an outer band 192 for the rotor disc, with a feed region 194 having curved feeding bars 195. The opposing stator band 196, as illustrated in FIG. 8E, does not have bars in the inner feed region 198 in opposition to the curved bars, thereby accommodating the opposing curved feeding bars 195 on the outer band 192. Such an approach further ensures a complete separation between the defibration and fibrillation steps in the inner and outer bands, respectively.

As shown in figures, the curved feeding (injector) bars 195 can optionally be supplemented with other structure in the feeding region of the rotor and/or stator bands (such as pyramids and opposed radial bars) to aid in the distribution of material from the curved bars into the working region. Thus, the surface of the radial extent of feed region 194 of the rotor can be fully or partially occupied by projecting curved bars 195 and the surface of the radial extent of the feed region 198 of the stator can be entirely flat, or partially occupied by distribution structure. The curved bars 195 of the rotor band project in the feed region 194 a distance greater than the height of the bars in the working region, but the flatness of the opposed surface in the feeding region 198 of the stator band accommodates this greater height.

In general, the pattern of bars and grooves throughout the working region of the inner band has a first average, preferably uniform, density and the pattern of bars and grooves throughout the feed region of the outer band has a second average, preferably uniform but lower density.

As will be described below, the invention has shown significant advantages when demonstrated in a pilot plant in which the primary refining disc diameter was effectively 36 inches. The invention is especially suitable when implemented in larger refiners, having disc diameters in the range of about 45 to 60 inches or more.

2. Pilot Plant Laboratory Realization

Figure 9:
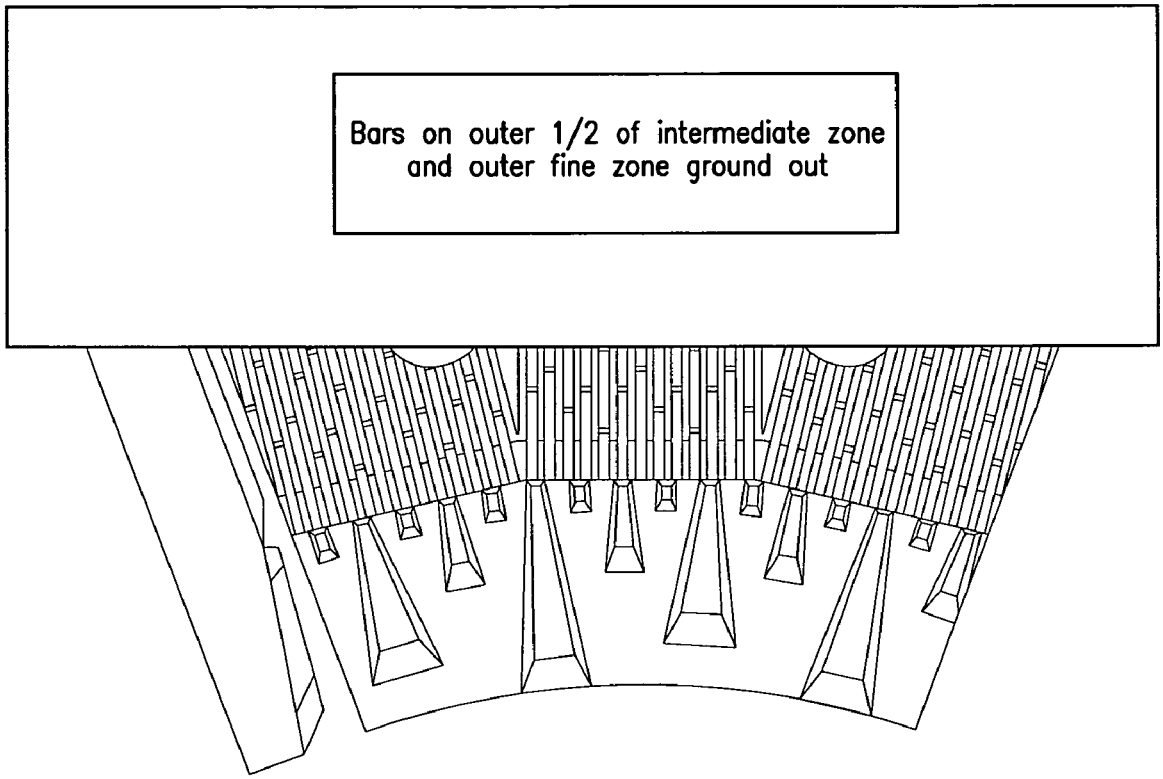
FIG. 9 is a schematic of the plate used in laboratory experiments to model and obtain measurements of the operational characteristics of the inner fiberizing plate.
Figure 10:
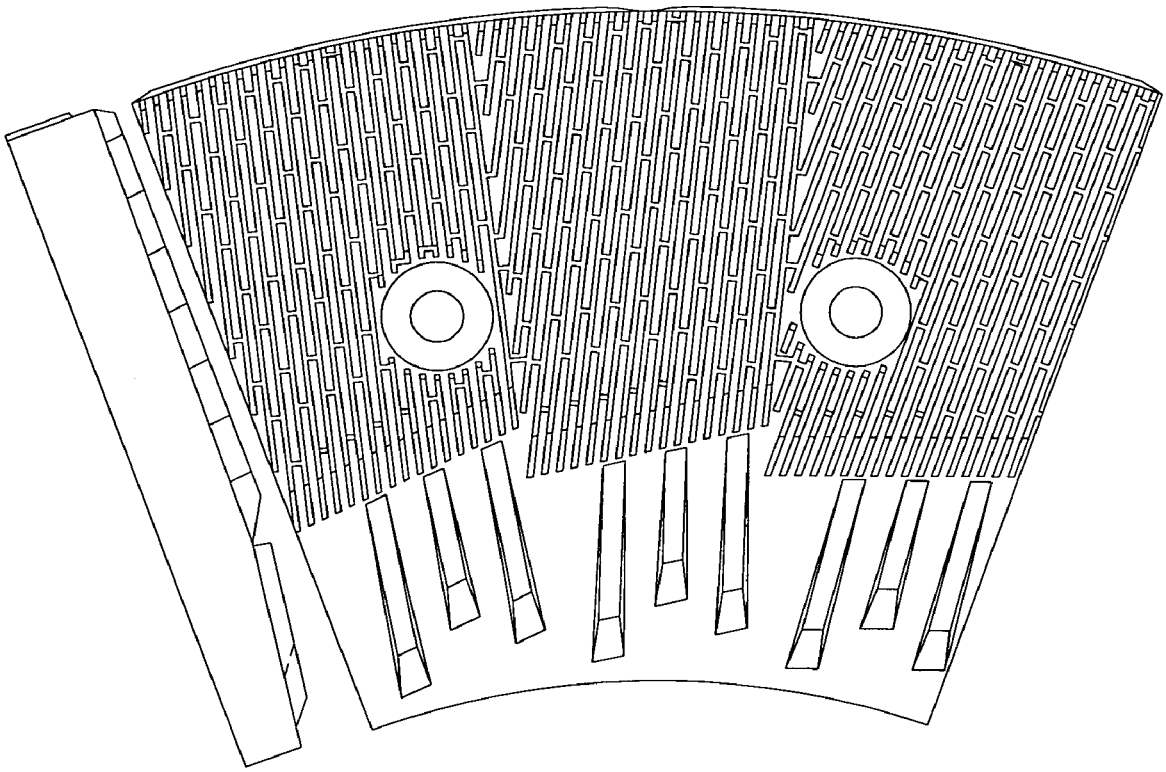
FIG. 10 is a schematic of the plate used in laboratory experiments to model and obtain measurements of the operational characteristics of the outer, fibrillating plate.

The combination of fiberizing inner bands and high-efficiency outer bands is therefore an important component of this process. The optimization of this process was conducted by running an Andritz pressurized 36-1CP single disc refiner in two steps, firstly using only inner plates and secondly using only the outer plates. For the inner plates, a special Durametal D14B002 three zone refiner plate was used with ½ of the outer intermediate zone and the entire outer zone ground out (see FIG. 9). The inner ½ of the intermediate zone is used to fiberize the destructured wood chips. For the outer plate, a Durametal 36604 directional refiner plate was used in both feeding (expel) and restraining (holdback) refining configurations (see FIG. 10).

Three refining configurations were run using the fiberizer plate inners to simulate the following process variations:

1. TMPA [2-3 sec. retention (i), 85 psig, 1800 rpm] ii) See A1 from data tables.
2. TMPB [2-3 sec. retention (i), 85 psig, 2300 rpm] ii). See A2 from data tables.
3. TMP [2-3 sec. retention (i), 50 psig, 1800 rpm] iii). See A3 from data tables.

i) Retention from pressurized screw discharge to refiner Inlet.

ii) Steaming Tube Pressure=5 psi, retention=30 seconds.

iii) Steaming Tube Pressure=20 psi, retention=3 minutes.

The precursor used to represent the combination of macerating pressurized screw discharger destructuring and fiberizing inner plates is f-. Therefore the nomenclature used for the preceding configurations are:

1) f-TMPA
2) f-TMPB
3) f-TMP

The fiberized (f) material was then refined using the refiner plate outers at similar respective conditions of pressure and refiner speed i.e.

1) f-TMPA outers: 85 psig, 1800 rpm
2) f-TMPB outers: 85 psig, 2300 rpm
3) f-TMP outers: 50 psig, 1800 rpm The majority of the specific energy was applied during the refiner outer runs. Different conditions of refiner plate direction (expel and holdback) and applied power were evaluated during the outer runs in this investigation.

Each of the primary refined pulps was then refined in a secondary atmospheric Andritz 401 refiner at three levels of applied specific energy.

Control TMP series were also produced without destructuring of the wood chips in the pressurized macerating discharger. This was accomplished by decreasing the production rate of the inners control run from 24.1 ODMTPD to 9.4 ODMTPD. This effectively reduced the plug of chips in the PMSD. The plates were backed off during the control inners run such that size reduction was accomplished using only the breaker bars i.e., no effective refining action by the refiner fiberizing bars following the breaker bars. The inners chips were then refined in the 36-1CP refiner using the outers plates. The primary refined pulps were then refined in the Andritz 401 refiner at several levels of specific energy.

TABLE A presents the nomenclature for each of the refiner series produced in this trial study. The corresponding sample identifications are also presented.

TABLE A

| | Sample Identification | | |
|---|---|---|---|
| Nomenclature* | Primary Inners | Primary Outers | Secondary |
| f-TMPA 1800 hb 485 ml | A1 | A4 | A7, A8, A9 |
| f-TMPA 1800 ex 663 ml | A1 | A5 | A10, A11, A12 |
| f-TMPA 1800 ex 661 ml | A1 | A6 | A13, A14, A15 |
| f-TMPA 1800 ex 460 ml | A1 | A16 | A22, A23, A24 |
| f-TMPA 1800 ex 640 ml (2.8% $NaHSO_3$) | A1 | A17 | A25, A26, A27 |
| f-TMPA 1800 hb 588 ml | A1 | A18 | A28, A29, A30 |
| f-TMPB 2300 ex 617 ml | A2 | A19 | A31, A32, A33 |
| f-TMPB 2300 ex 538 ml (3.1% $NaHSO_3$) | A2 | A20 | A34, A35, A36 |
| f-TMP 1800 ex 597 ml | A3 | A21 | A37, A38, A39 |
| f-TMP 1800 hb 524 ml | A3 | A41 | A46, A47, A48 |
| TMP 1800 hb 664 ml | A3-1 | A44 | A54, A55, A56, A57, A58 |
| TMP** 1800 hb 775 ml | A3-1 | A43 | A49, A50, A51, A52, A53 |

*Nomenclature = process, 1ry refiner speed (1800 rpm or 2300 rpm), 1ry outers configuration (ex or hb), 1ry refined freeness
**No good since primary refiner freeness was too high.

The refiner series produced with the primary outers in holdback had a larger plate gap and higher long fiber content than the respective series produced using expelling outers. This permitted refining the holdback series to lower primary freeness levels while retaining the long fiber content of the pulp.

FIGS. 11-18 illustrate pulp property results for most of the refiner series produced in this investigation. The two series produced at very low primary freeness (<500 ml) are excluded from the plots due to congestion.

Figure 11:
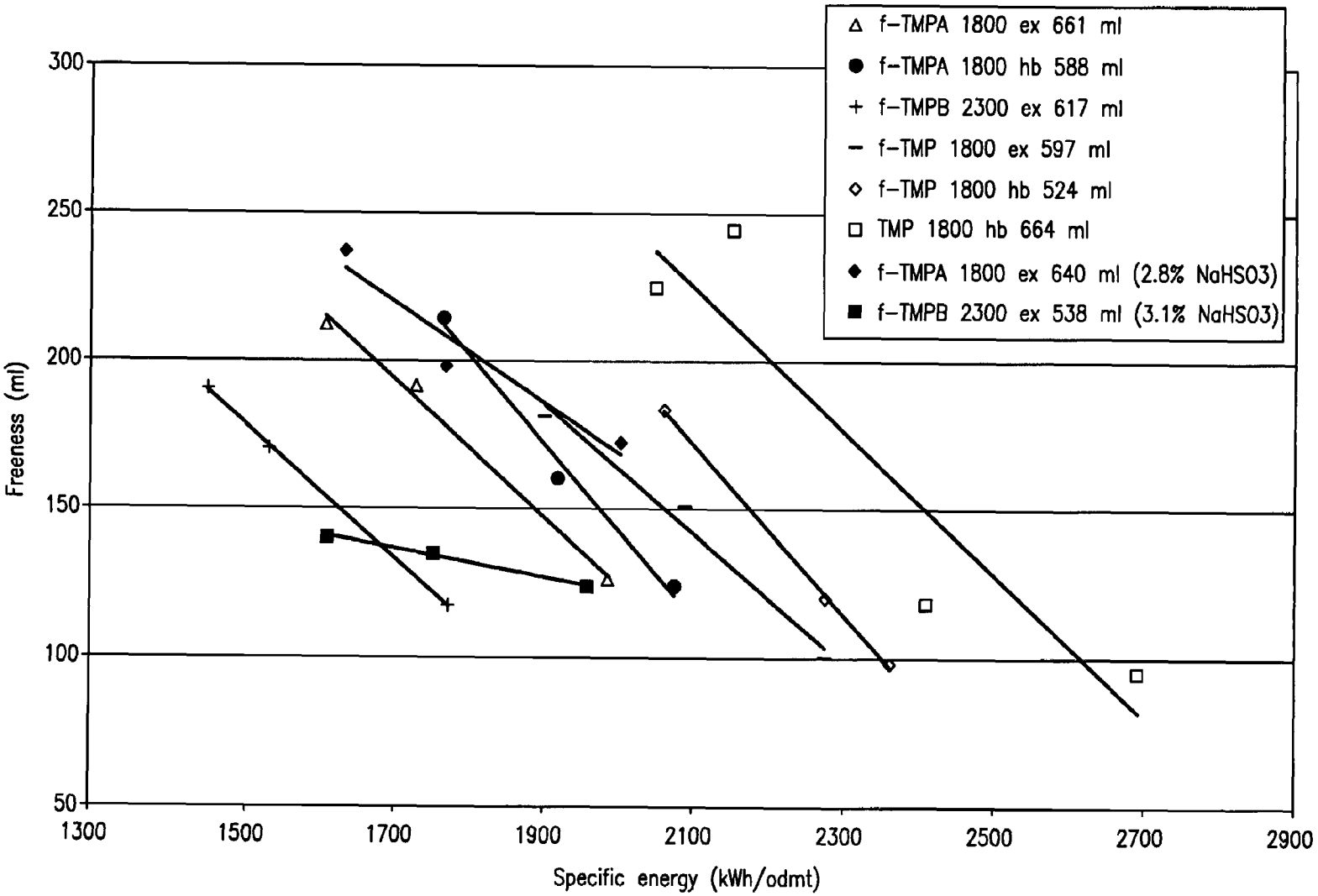
FIGS. 11-18 illustrate pulp property results for various refiner series test runs to investigate aspects of the invention.

FIG. 11. Freeness Versus Specific Energy

The control TMP series had the highest specific energy requirements to a given freeness. The f-TMP series had the next highest energy requirements followed by the f-TMPA series. The f-TMPB series had the lowest specific energy requirements to a given freeness.

TABLE B compares the specific energy requirements for each of the plotted refiner series at a freeness of 150 ml. The results are from linear interpolation.

TABLE B

Specific Energy at 150 ml.

| | Specific Energy (kWh/MT) |
|---|---|
| f-TMPA 1800 ex 661 ml | 1889 |
| f-TMPA 1800 hb 588 ml | 1975 |
| f-TMPB 2300 ex 617 ml | 1626 |
| f-TMP 1800 ex 597 ml | 2060 |
| f-TMP 1800 hb 524 ml | 2175 |
| TMP 1800 hb 664 ml | 2411 |
| f-TMPA 1800 ex 640 ml (2.8% $NaHSO_3$) | 2111* |
| f-TMPB 2300 ex 538 ml (3.1% $NaHSO_3$) | 1411* |

*By extrapolation.

The f-TMPB 2300 ex series (combination of fiberizing, TMPB, and high intensity plates) had a 32% lower energy requirement than the control TMP series to freeness of 150 ml. The f-TMPA 1800 hb and f-TMPA 1800 ex series had 18% and 22%, respectively, lower energy requirements than the control TMP series at 150 ml. The f-TMP hb and f-TMP ex series had 10% and 15%, respectively, lower energy requirements than the control TMP series. The results indicate that rebuilding/replacing the pressured screw discharger and refiner plates can generate a substantial return on investment for existing TMP systems.

Figure 12:
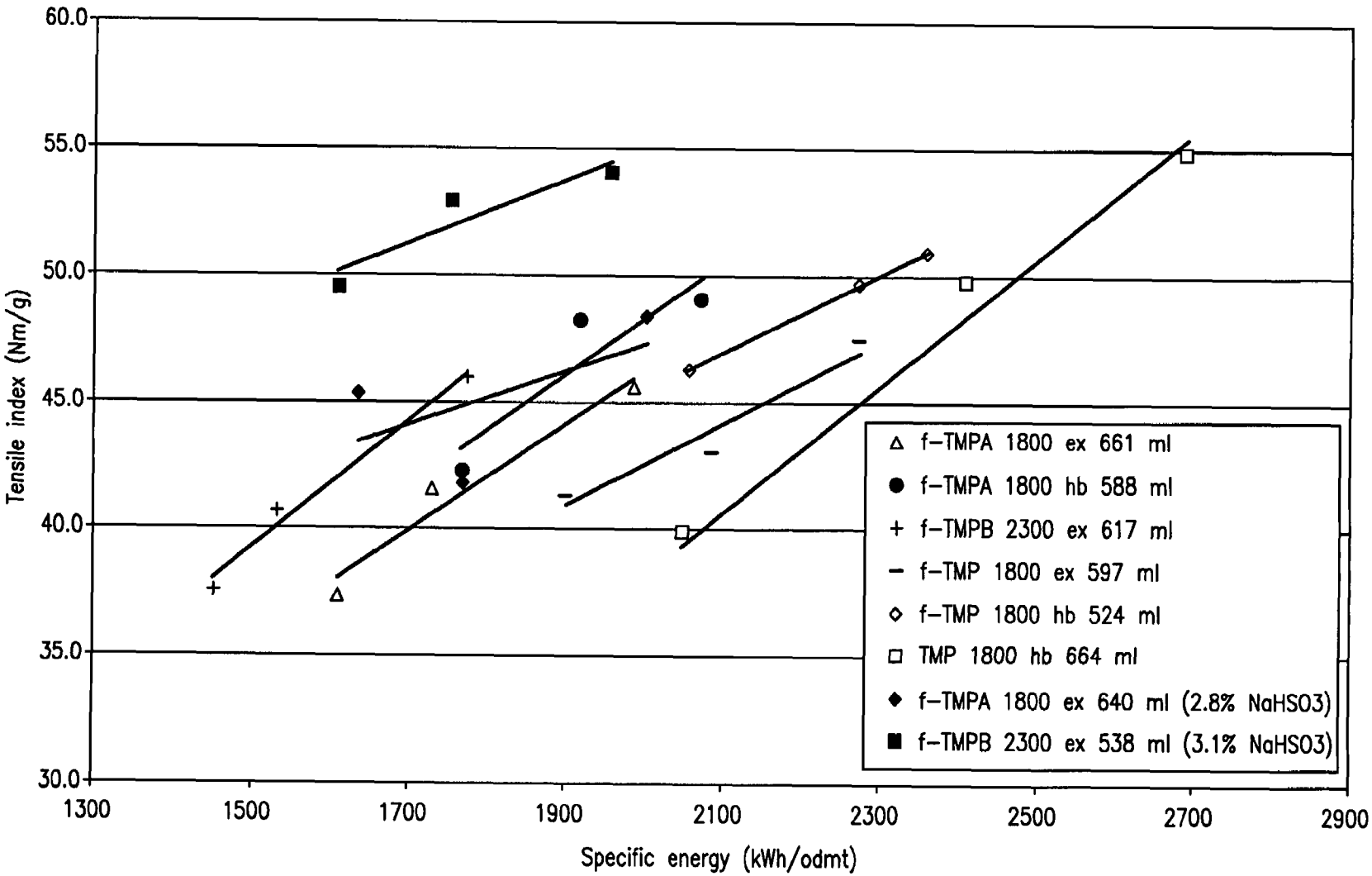

FIG. 12. Tensile Index Versus Specific Energy

The f-TMPB ex pulps had the highest tensile index at a given application of specific energy, followed by the f-TMPA series and then the f-TMP series. The control TMP pulps had the lowest tensile index at a given application of specific energy.

The addition of approximately 3% sodium bisulfite ($NaHSO_3$) solution to the pressurized screw discharger increased the tensile index relative to the respective series without chemical treatment.

A 52.5 Nm/g tensile index was achieved with the f-TMPB 2300 ex (3.1% $NaHSO_3$) series with an application of 3.1% $NaHSO_3$ and 1754 kWh/ODMT.

Figure 13:
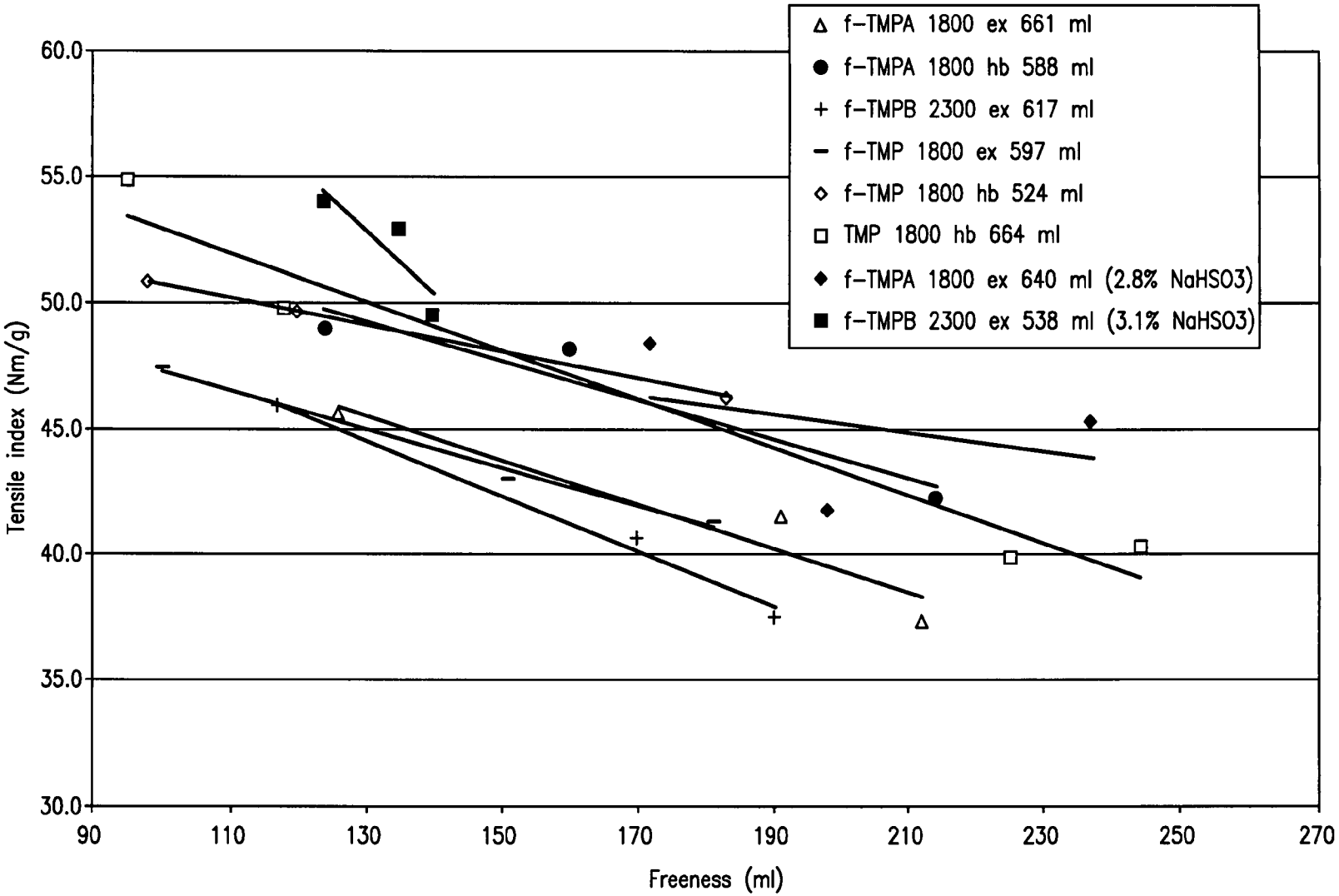

FIG. 13. Tensile Index Versus Freeness

Non-Chemically Treated Series

There were two bands of tensile index results. The lower band represents the series produced using the expelling outer plates. The upper band represents the series produced using the holdback outer plates. The average increase in tensile index using the holdback plates was approximately 10%. It is noted that an f-TMPB hb series was not conducted in this trial due to a shortage of fiberized A3 material.

Bisulfite Treated Series

The addition of approximately 3% bisulfite to the f-TMPA ex and f-TMPB ex series elevated the tensile index to a similar or higher level than the holdback pulps.

TABLE C compares each of the refiner series at a freeness of 150 ml. The regression equations used in the interpolations are included on FIG. 13.

TABLE C

Tensile Index at 150 ml

| | Tensile Index (Nm/g) |
|---|---|
| f-TMPA 1800 ex 661 ml | 43.8 |
| f-TMPA 1800 hb 588 ml | 47.7 |
| f-TMPB 2300 ex 617 ml | 42.4 |
| f-TMP 1800 ex 597 ml | 43.5 |
| f-TMP 1800 hb 524 ml | 48.1 |
| TMP 1800 hb 664 ml | 48.2 |
| f-TMPA 1800 ex 640 ml (2.8% $NaHSO_3$) | 47.0* |
| f-TMPB 2300 ex 538 ml (3.1% $NaHSO_3$) | 47.9* |

*By extrapolation.

Figure 14:
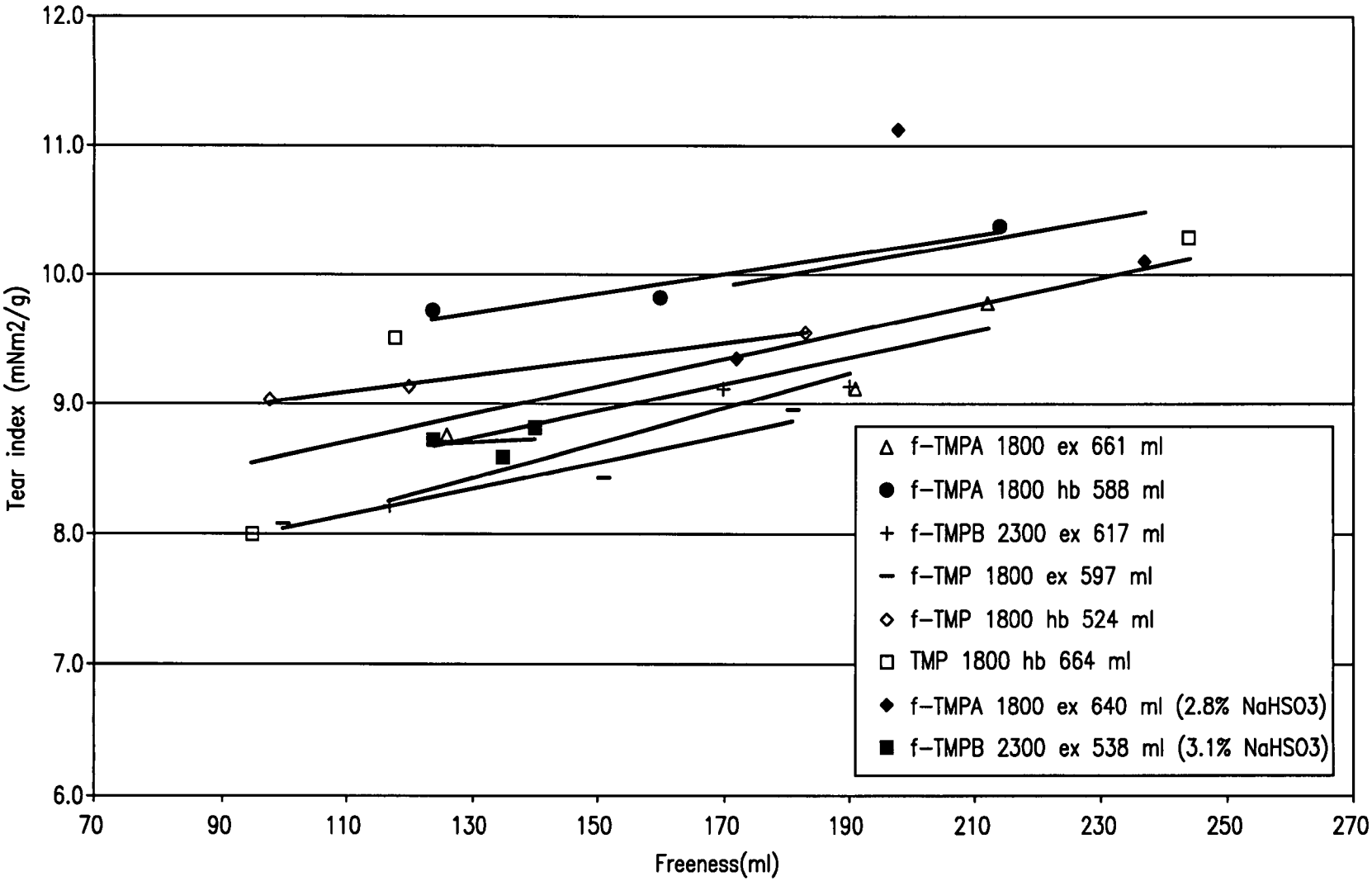
Figure 15:
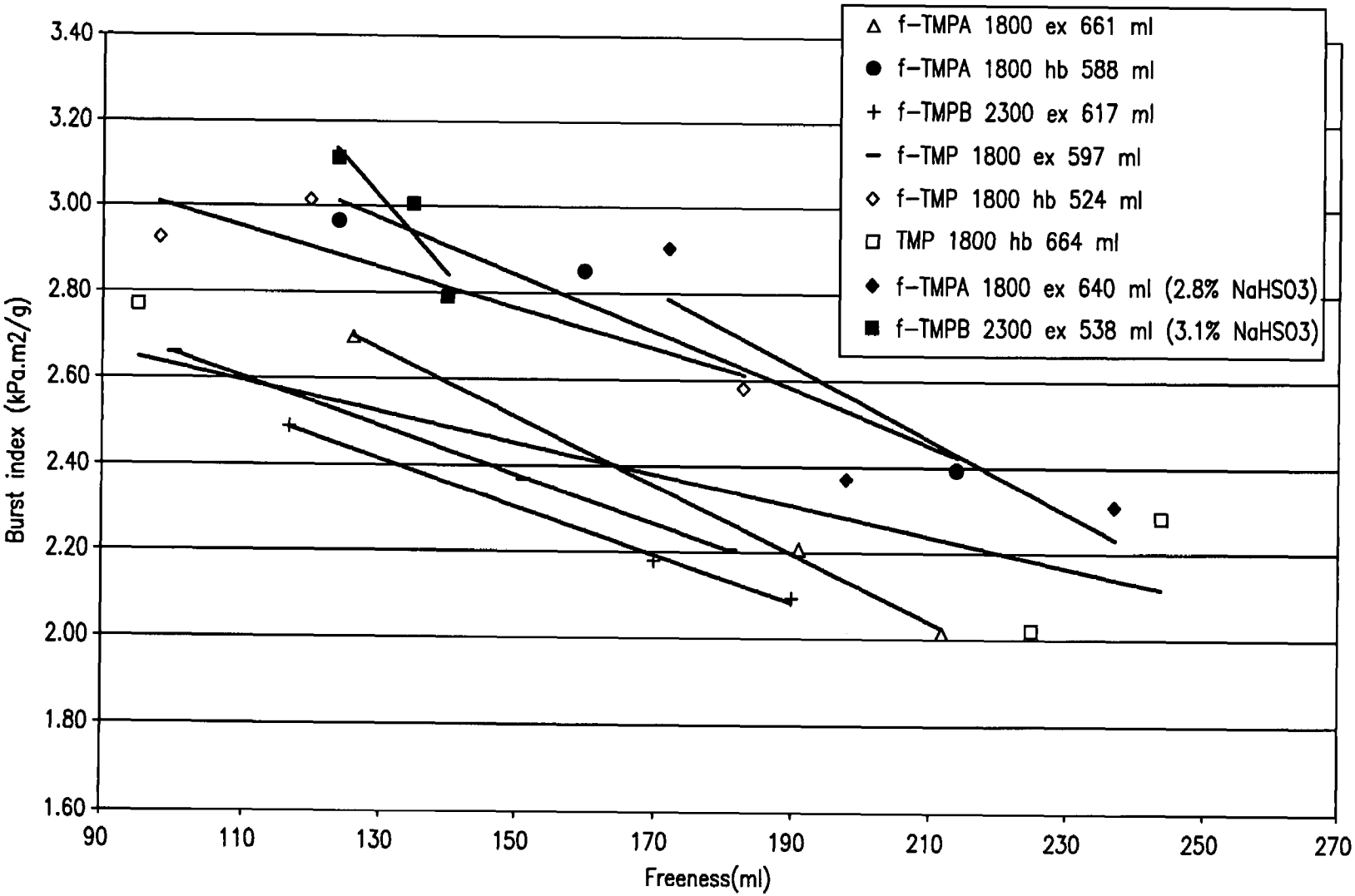

FIG. 14. Tear Index Versus Freeness

The refiner series produced using holdback outer plates had the highest tear index and long fiber content.

TABLE D compares the refiner series at a freeness of 150 ml. The tear index values were obtained using linear interpolation.

TABLE D

Tear Index at 150 ml

| | Tear Index ($mN \cdot m^2/g$) |
|---|---|
| f-TMPA 1800 ex 661 ml | 9.0 |
| f-TMPA 1800 hb 588 ml | 9.9 |
| f-TMPB 2300 ex 617 ml | 8.7 |
| f-TMP 1800 ex 597 ml | 8.6 |
| f-TMP 1800 hb 524 ml | 9.3 |
| TMP 1800 hb 664 ml | 9.1 |
| f-TMPA 1800 ex 640 ml (2.8% $NaHSO_3$)* | 9.7 |
| f-TMPB 2300 ex 538 ml (3.1% $NaHSO_3$)* | 8.8 |

*By extrapolation.

The f-TMPA hb pulps had the highest tear index. The f-TMPA ex and f-TMPB ex pulps had comparable tear index results FIG. 15. Burst Index Versus Freeness The f-TMPA 1800 hb and f-TMP 1800 hb series produced with holdback outer plates had the highest burst index at a given freeness. The refiner series produced with expelling outer plates, f-TMPA 1800 ex, f-TMP 1800 ex, f-TMPB 2300 ex, had a lower burst index at a given freeness.

The addition of approximately 3% bisulfite increased the burst index of the series produced with expelling outer plates to a similar level as the non-chemically treated series produced with holdback outer plates.

TABLE E compares the burst index results interpolated to a freeness of 150 ml.

TABLE E

Burst Index at 150 ml

| | Burst Index ($kPa \cdot m^2/g$) |
|---|---|
| f-TMPA 1800 ex 661 ml | 2.51 |
| f-TMPA 1800 hb 588 ml | 2.85 |
| f-TMPB 2300 ex 617 ml | 2.30 |
| f-TMP 1800 ex 597 ml | 2.38 |
| f-TMP 1800 hb 524 ml | 2.76 |
| TMP 1800 hb 664 ml | 2.45 |
| f-TMPA 1800 ex 640 ml (2.8% $NaHSO_3$)* | 2.98 |
| f-TMPB 2300 ex 538 ml (3.1% $NaHSO_3$)* | 2.67 |

*By extrapolation.

Figure 16:
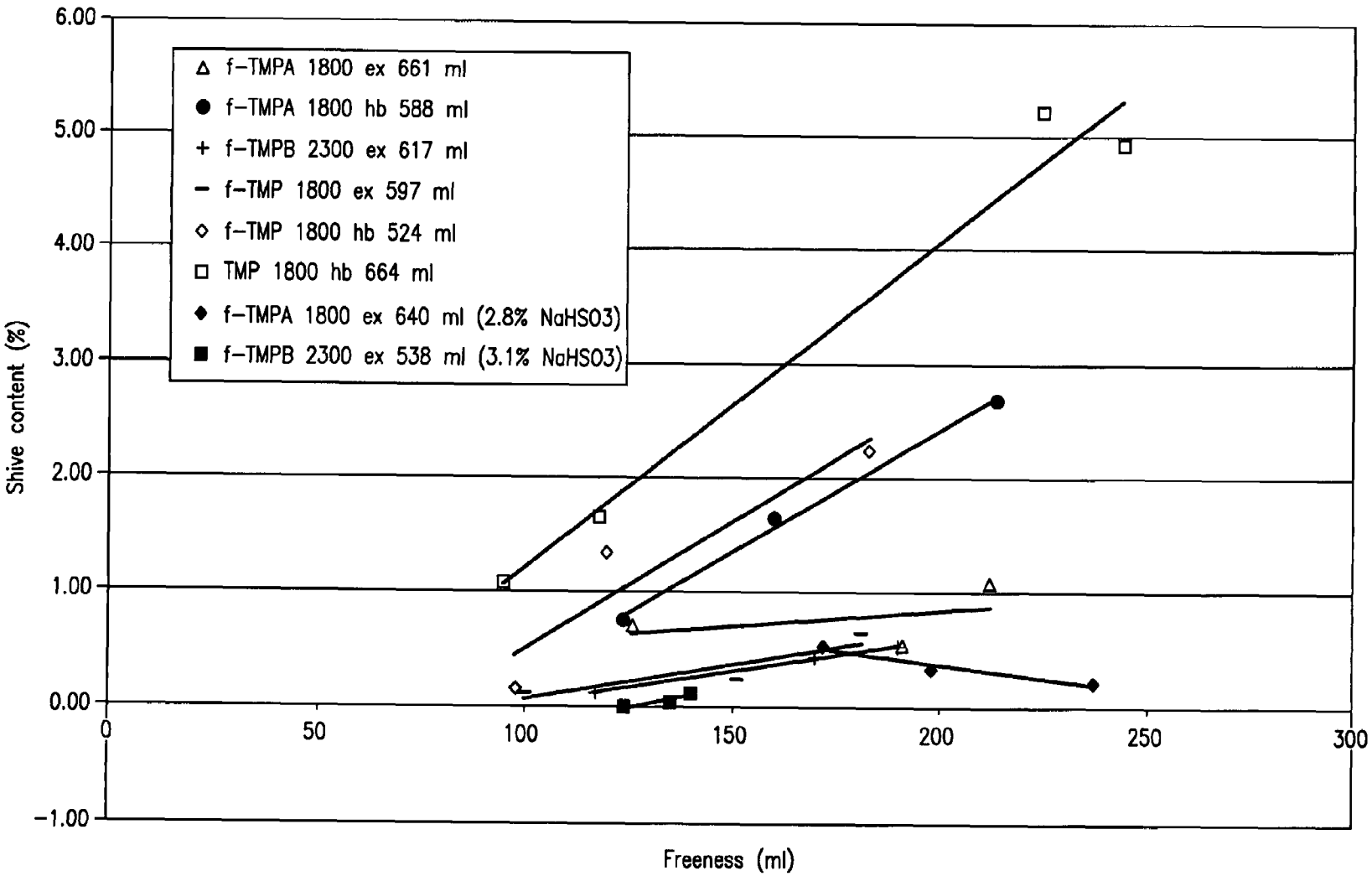

FIG. 16. Shive Content Versus Freeness

The control TMP pulps had the highest shive content levels. The refiner series produced with the expelling outer plates had lower shive content levels than the respective series produced with holdback outer plates. It was clearly evident that the f-pretreatment helps reduce shive content.

TABLE F compares the shive content levels for each refiner series interpolated to a freeness of 150 ml.

TABLE F

Shive Content at 150 ml.

| | Shive Content (%) |
|---|---|
| f-TMPA 1800 ex 661 ml | 0.70 |
| f-TMPA 1800 hb 588 ml | 1.35 |
| f-TMPB 2300 ex 617 ml | 0.31 |
| f-TMP 1800 ex 597 ml | 0.37 |
| f-TMP 1800 hb 524 ml | 1.61 |
| TMP 1800 hb 664 ml | 2.63 |
| f-TMPA 1800 ex 640 ml (2.8% $NaHSO_3$)* | 0.59 |
| f-TMPB 2300 ex 538 ml (3.1% $NaHSO_3$)* | 0.18 |

*By extrapolation.

The f-TMPB ex series produced with and without bisulfite addition had the lowest shive content levels. The addition of bisulfite lowered the shive content.

Figure 17:
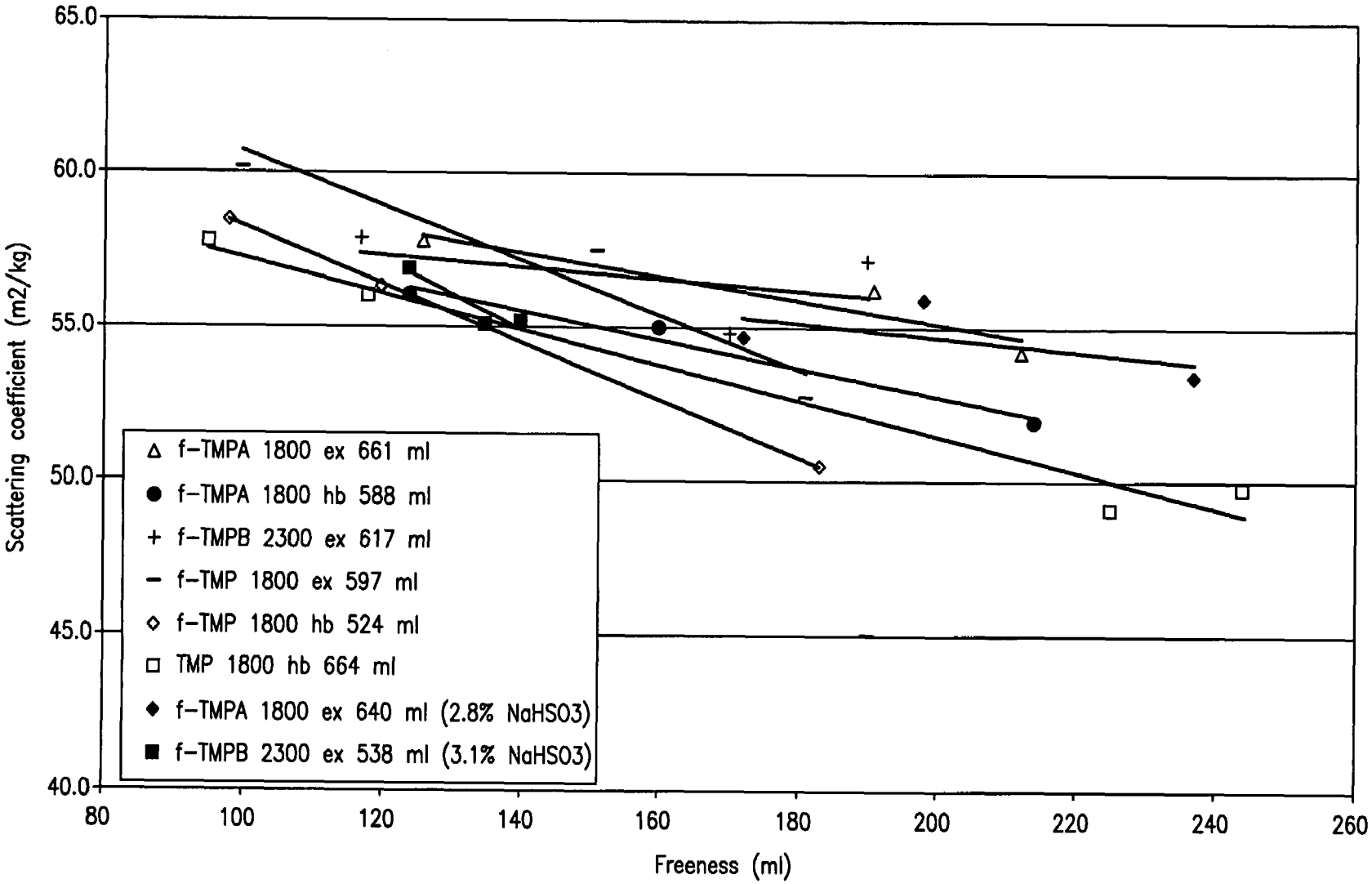

FIG. 17. Scattering Coefficient Versus Freeness

The refiner series produced with the expelling outer plates had the highest scattering coefficient levels.

TABLE G presents the scattering coefficient results for each series at a freeness of 150 ml.

TABLE G

Scattering Coefficient versus Freeness

| | Scattering Coefficient ($m^2/kg$) |
|---|---|
| f-TMPA 1800 ex 661 ml | 57.1 |
| f-TMPA 1800 hb 588 ml | 55.1 |
| f-TMPB 2300 ex 617 ml | 56.8 |

TABLE G-continued

Scattering Coefficient versus Freeness

| | Scattering Coefficient ($m^2$/kg) |
|---|---|
| f-TMP 1800 ex 597 ml | 56.3 |
| f-TMP 1800 hb 524 ml | 53.6 |
| TMP 1800 hb 664 ml | 54.4 |
| f-TMPA 1800 ex 640 ml (2.8% $NaHSO_3$)* | 55.9 |
| f-TMPB 2300 ex 538 ml (3.1% $NaHSO_3$)* | 53.8 |

*By extrapolation.

The addition of approximately 3% bisulfite reduced the scattering coefficient by approximately 1-3 $m^2$/kg.

Figure 18:
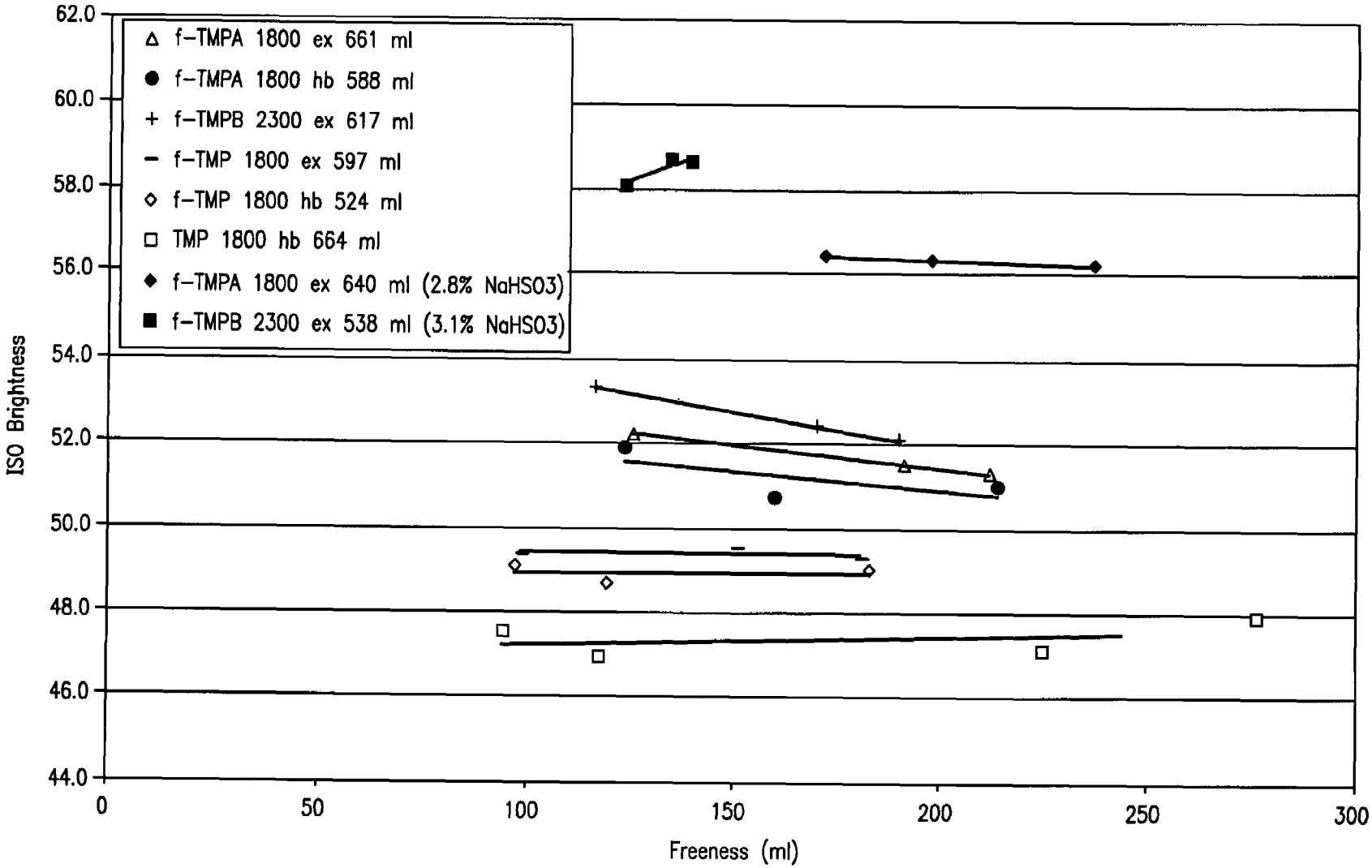

FIG. 18. Brightness Versus Freeness

All the f-series had higher brightness than the control TMP pulps.

TABLE H compares each of the refiner series interpolated to a freeness of 150 ml.

TABLE H

ISO Brightness at 150 ml

| | ISO Brightness |
|---|---|
| f-TMPA 1800 ex 661 ml | 52.0 |
| f-TMPA 1800 hb 588 ml | 51.3 |
| f-TMPB 2300 ex 617 ml | 52.8 |
| f-TMP 1800 ex 597 ml | 49.4 |
| f-TMP 1800 hb 524 ml | 48.9 |
| TMP 1800 hb 664 ml | 47.3 |
| f-TMPA 1800 ex 640 ml (2.8% $NaHSO_3$)* | 56.5 |
| f-TMPB 2300 ex 538 ml (3.1% $NaHSO_3$)* | 59.1 |

*By extrapolation.

The f-TMP series had approximately 2% higher brightness than the control TMP series. A higher removal of wood extractives from the high compression pressurized screw discharger component of the f-pretreatment most probably contributed to the brightness increase.

The f-TMPB series had the highest brightness (52.8) followed by the f-TMPA series (average=51.7), then the f-TMP series (average=49.2).

The addition of 3% bisulfite increased the brightness considerably, up to 59.1 with the f-TMPB ex series.

3. Comparing Defibration Conditions During Inner Zone Refining

TABLE I compares the fiberized properties following the inner plates. As indicated earlier, three fiberizer runs, A1, A2, A3 were conducted to simulate the f-TMPA, f-TMPB and f-TMP configurations. Each of these inner band runs was fed with destructured chips from the pressurized screw discharger.

TABLE I

Fiberized Properties following Inner Plates

| Fiberizer (f-) Run | Process | Pressure (psi) | Throughput (ODMTPD) | Specific Energy (kWh/ODMT) | Shive Content (%) | +28 Mesh (%) |
|---|---|---|---|---|---|---|
| A1 | TMPA | 85 | 23.3 | 152 | 66.5 | 75.4 |
| A2 | TMPB | 85 | 23.3 | 122 | 35.6 | 79.4 |
| A3 | TMP | 50 | 24.1 | 243 | 88.7 | 82.4 |

It is evident that the process conditions have a major impact on the defibration efficiency during inner zone refining. The destructured chips refined at higher pressure (A1, A2) had a significantly lower shive content (more defibrated fibers) compared to refining at a typical TMP pressure (50 psi). The energy requirement for defibration was also lower at high pressure. The highest defibration level was obtained when combining high pressure and high speed (A2).

The A2 (f-TMPB) material demonstrated the highest fiber separation, followed by the A1 (f-TMPA) material. The A3 (f-TMP) was clearly the coarsest of the fiberized samples.

It is noted that bar directionality was not a factor during the inner refining runs since the inner plates were bidirectional.

The energy for defibration decreases with an increase in pressure. The energy losses are quite substantial when defibrating at conventional conditions. For example, at a pressure of 50 psig, an additional specific energy requirement of well over 100 kWh/MT would be necessary when producing fiberized material to the same shives level as compared to refining at 85 psig.

4. Laboratory Procedures

White spruce chips from Wisconsin were used for these examples. Material identification, solids content and bulk density for the spruce chips appear in TABLE II.

Initially, several runs were carried out on the 36-1CP pressurized variable speed refiner utilizing plate pattern D14B002 with the outer zone and ½ intermediate zone ground out. This was conducted to simulate the inner bands of larger single disc refiners. The first run A1 was produced with 30-second presteam retention in the steaming tube at 0.4 bar, 5.87 bar refiner casing pressure, and a machine speed of 1800 rpm. For A2, the machine speed was increased to 2300 rpm. The A3 run was produced with 3 minutes presteam retention at 1.38 bar, 3.45 bar refiner casing pressure, and refiner disc speed of 1800 rpm. Run A3-1 was also conducted at similar conditions as A3, except the production rate was decreased from 24.1 ODMTPD to 9.4 ODMTPD in order to prevent destructuring of the chips prior to feeding the refiner. The plate gap for this run was also increased to eliminate any effective action by the intermediate bar zone, such that the chips received breaker bar treatment only. Fiber quality analysis was not possible on sample A1-1 since chips receiving breaker bar treatment only are not in a fiberized form; therefore shive or Bauer McNett analysis is not applicable.

Each of these pulps was used to produce additional series. Six series were carried out on the A1 material. The outer plates (Durametal 36604) were installed in the 36-1CP refiner to simulate the outer zone of refining. All six primary outer zone runs were refined on the 36-1CP at 5.87 bar casing pressure and at a disc speed of 1800 rpm. The process nomenclature for these runs is TMPA. A sodium bisulfite liquor was added to A17 resulting in a chemical charge of 2.8% $NaHSO_3$ (on O.D. wood basis). Three secondary refiner runs were produced on each series.

Two series were produced on the A2 material. Both 36-1CP outer zone runs produced (A19 and A20) were produced at 5.87 bar refiner casing pressure and 2300 rpm machine speed. The process nomenclature for these runs is TMPB. Sodium bisulfite liquor was added to A20 (3.1% $NaHSO_3$). Again three secondary refiner runs were produced on each.

Several series were also produced on the A3 material, each at 3.45 bar refiner casing pressure and 1800 rpm. Three secondary refiner runs were produced on each. The process nomenclature for these runs is TMP.

Two control TMP series were produced (A43 and A44) on the A3-1 chips, which went through breaker bar treatment only during inner zone refining. Both A43 and A44 were refined at 3.45 bar steaming pressure and 1800 rpm machine speed. Several atmospheric refiner runs were then conducted on these pulps to decrease the freeness to a comparable range as the earlier produced series.

All pulps were tested in accordance with standard Tappi procedures. Testing included Canadian Standard Freeness, Pulmac Shives (0.10 mm screen), Bauer McNett classifications, optical fiber length analyses, physical and optical properties.

TABLE I-A

GRAPHIC RUN SUMMARY

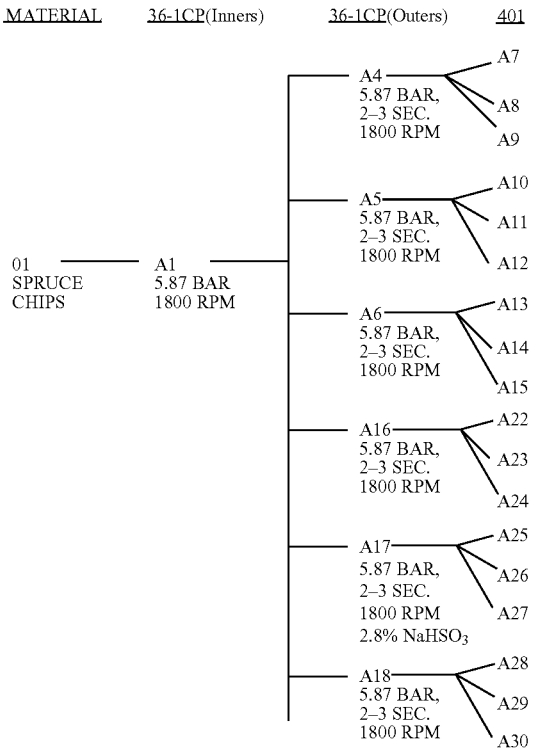

NOTE: A1 USED D14B002 PLATES- OUTER TAPER AND ½ INTERMEDIATE ZONE AND OUTER ZONE GROUND OUT. A1 TUBE PRESSURE OF 0.69 BAR, A4, A5, A6, A16, A17 and A18 TUBE PRESSURE 0.34 BAR. A5, A6, A16 and A17 REFINED IN REVERSE MODE.

TABLE I-B

GRAPHIC RUN SUMMARY

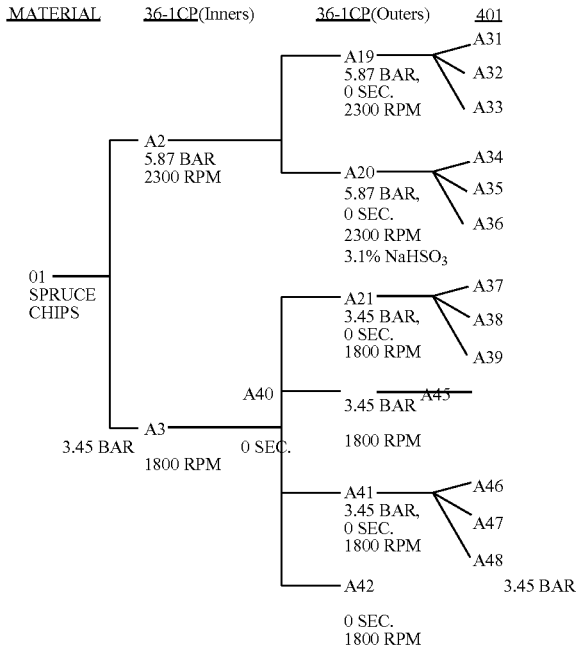

NOTE: A2 AND A3 USED D14B002 PLATES OUTER TAPER AND ½ INTERMEDIATE ZONE AND OUTER ZONE GROUND OUT. A2 TUBE PRESSURE OF 0.69 BAR, A3 TUBE PRESSURE 1.38 BAR. A19, A20, A21, A40, A41 and A42 TUBE PRESSURE 0.34 BAR. A19, A20, A21 REFINED IN REVERSE MODE.

TABLE I-C

GRAPHIC RUN SUMMARY

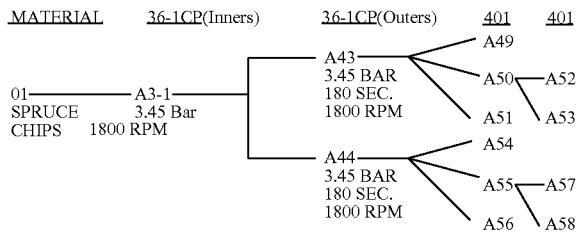

TABLE II

MATERIAL IDENTIFICATION

| MATERIAL | | % O.D. SOLIDS | BULK DENSITY ($kg/m^3$) WET | BULK DENSITY ($kg/m^3$) DRY |
|---|---|---|---|---|
| 01 | SPRUCE | 66.5 | 169.8 | 112.9 |
| | SOAKED | 47.7 | | |

5. Steam Management

As described above with respect to FIGS. 3, 4, and 5, the refiner plates are arranged in confronting coaxial relation thereby defining a refiner gap that extends substantially radially outward from the inner radius of the discs to the outer radius of the discs. The refiner gap includes an outer gap 158 defined between the confronting outer bands such as 152A and 152B, and an inner gap 156 defined between the confronting inner bands such as 150A and 150B. For ideal fibration of the destructured chip material, the working region 110 of one inner band should be closely spaced from the working region 110 of the opposed inner band. This gap is in the range of 1.5-3.0 mm and ideally about 2 mm. However, a tight gap between the inner bands for a working region that has a fine enough pattern of bars and grooves to achieve the desired fibrating effect can result in blockage of steam flow back to the ribbon feeder 30 and any upstream preheater (see FIG. 1). In some known TMP systems, a backflow of steam generated during fibrillation is used to maintain the elevated pressure in the refiner preheater and ribbon feeder. In the present invention, steam is generated in the outer gap 158 between the working regions 112 of the outer bands. For compatibility with such known TMP systems, the composite plates of the present invention can be modified to permit backflow of steam despite the tighter gap at the working region of the inner plate.

In general, at least one of the confronting plates can include a steam backflow channel for directing some of the steam from the outer gap to the inner gap at the inner feed region 154 or a location further upstream, while bypassing the inner gap 156 at the inner working region.

Figure 19:
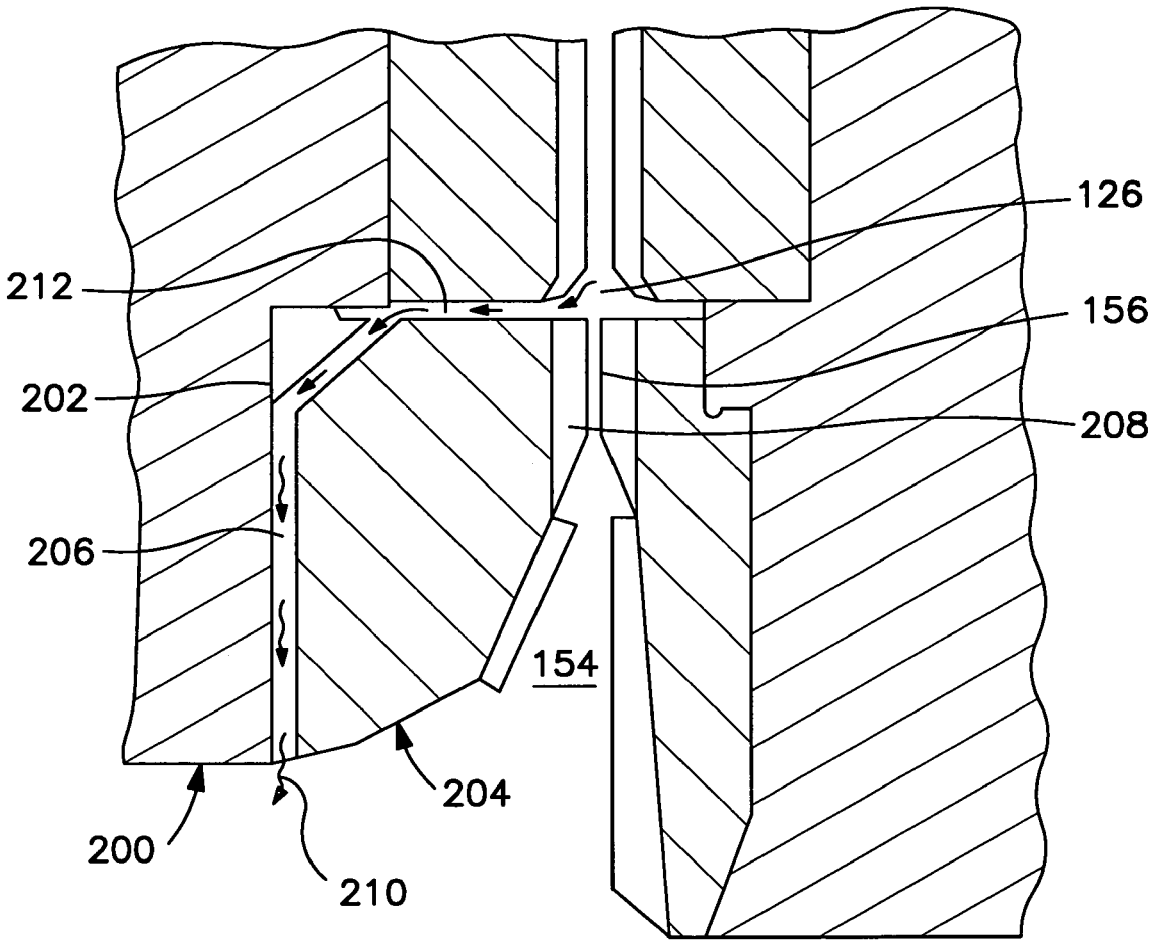
FIG. 19 shows a rotor and stator inner band pair, having a passageway in the inner stator band for managing the backflow of steam produced during refining.

One solution, shown in FIG. 19, is to open up the back side 202 of the inner plates 204 on the stator 200, which would allow steam 210 to travel in the channel 206 upstream in the process, behind the working region 208 of the inner band. This steam bypass would not adversely affect the fiber retention time in the inner bands (the retention time in the inner bands should be kept short in order to avoid too much fiber accumulation, which increases frictional losses and thus increases energy consumption). It is common practice to form each refiner plate from a plurality, for example ten, somewhat pie shaped segments or elements that are each bolted to the disc. In the present invention, the inner band can be formed from a set of inner band segments and the outer band can be formed from another set of outer band segments. Some or all of the inner band segments can have a radial through bore or a groove 206 at the back side (at the interface with the disc), for the steam to bypass the working region of the respective segment, with an inlet 212 exposed to the refiner gap 126 radially outside the working region of the inner band.

Figure 20:
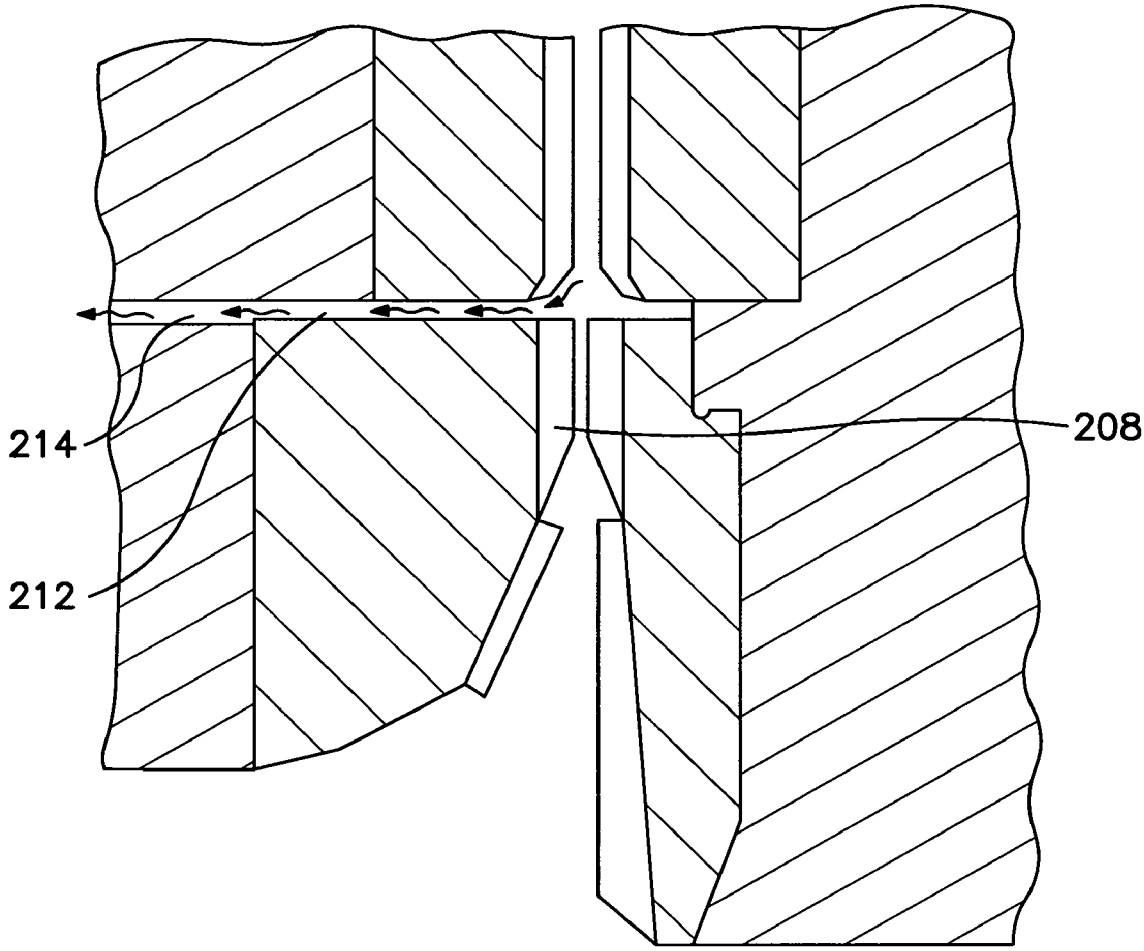
FIG. 20 is a view similar to FIG. 19, showing another embodiment for managing the backflow of steam, through a passageway in the disc supporting inner stator band.

As shown in FIG. 20, a variation includes a passageway 214 formed in the disc itself, preferably the stator. This can be especially effective where the plate is formed by distinct inner and outer bands that are attached to the disc such that an annular space 126 is formed between the bands. The inlet 212 for the steam bypass passageways can be located in the disc in this annular space. Such steam extraction path through the refiner disc, can alternatively be achieved by providing one or multiple holes in the disc, aligned with respective holes in the plates, anywhere radially outward of the inner working region 208. The holes would be connected to the feed side of the refiner via a piping arrangement, and the connection can be linked to one or more points located anywhere from the discharge of the plug screw feeder (or pressure seal to the feed system) and the inlet at the radial center of the refiner plates.

Figure 21:
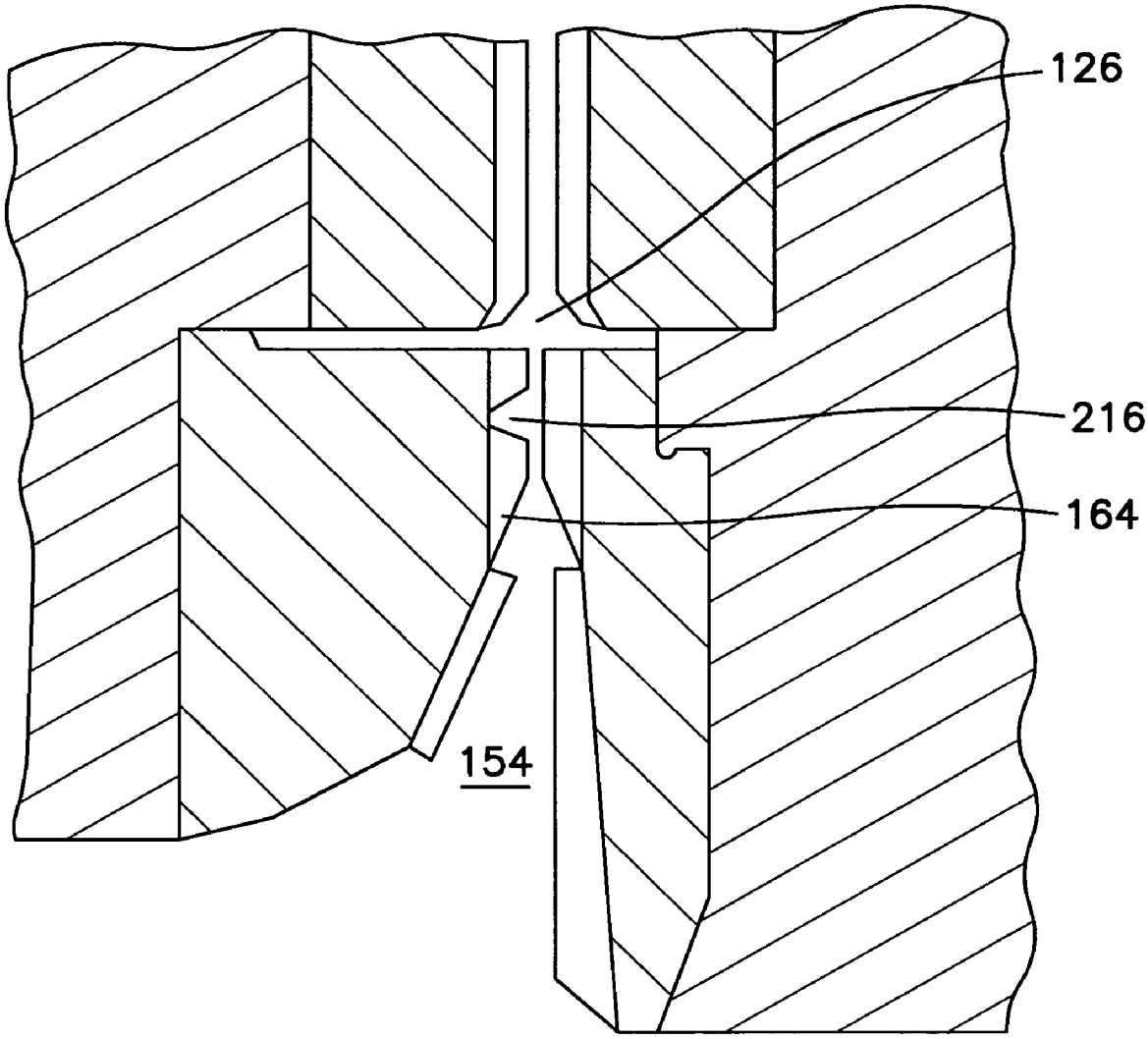
FIG. 21 is a view similar to FIG. 19, showing a further embodiment for managing the backflow of steam, through grooves on the surface of the working region of the inner band.
Figure 22:
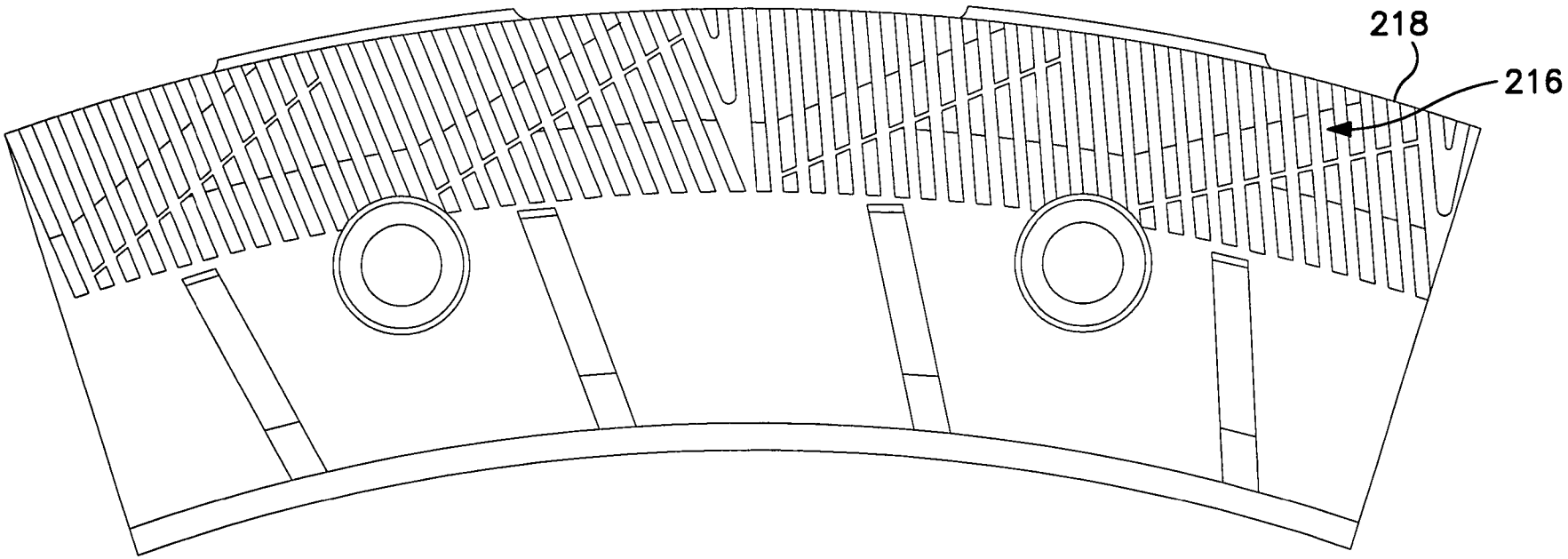
FIG. 22 is a view similar to FIG. 4B, with the addition of the reverse flow steam grooves on the front face of the working region of the inner band according to embodiment shown in FIG. 21.

Another solution, shown in FIGS. 21 and 22, involves a steam channel 216 at the surface of the working region 208 of the inner band, preferably in the stator. This channel is present for the sole purpose of allowing steam to flow back towards the feeding system instead of being trapped between the inner and outer bands. Such extraction channel runs diagonally or obliquity across the bar/groove pattern on the working inner band, either on the rotor, stator or both chamfer 164 on the bars of the working region or to the feed gap 154. The steam bypass channel has an inlet 218 at the annular space 126 between the inner and outer bands. Locating the channel in the stator offers the path of least resistance for the steam. The rotor would tend to pump steam forward, even with the channel, but the stator will let steam flow back. As with the previously described embodiment, the surface bypass channel would draw steam from the radially outer end of the working region 208, which would typically be at the spaced interface between the inner and outer bands. The grooves run away from the direction of rotation, so that feed material is not directed across the stator inner band grooves, allowing untreated chips to get through. In the illustrated embodiment, the angle of the grooves has been chosen in such as way that all the incoming chips are forced through the refining gap in order to reach the outer refining region. When viewed from the side, the steam bypass channel 216 is simply a notch in the plate pattern, running at an approximately 20-30 degree chamfer from horizontal on the bars going towards O.D., and a minimal chamfer on the bars extending towards I.D. This geometry helps to force wood chips back into the gap through mechanical forces, whenever material enters those steam escape grooves. The steam grooves can be deeper than the surrounding pattern (in this case they are the same depth), and the channel can be straight (as in this case) or curved.

Although various forms of steam grooves and even grooves through the back of the segments have been tried in the past, they were designed to help steam move forward, not backwards. To the inventors' knowledge, no one has modified refiner plates to increase the backflow of steam, i.e., in the reverse, upstream direction.

The invention claimed is:

1. In a primary wood chip refiner having flat, relatively rotating discs, each having a working plate thereon, the working plates being arranged in confronting coaxial relation thereby defining a refiner gap which extends substantially radially outward from the inner diameter of the discs to the outer diameter of the discs and defines a flow area for the chip material to be refined, the improvement comprising:

each plate having a radially inner fiberizing band and a radially outer fibrillating band, each band having an inner feeding region and an outer working region, wherein the working region of the inner band is defined by a first pattern of alternating bars and grooves, and the feeding region of the outer band is defined by a second pattern of alternating bars and grooves, and said flow area increases immediately after the inner working region into the outer feeding region;

the refiner gap includes an outer gap defined between the confronting outer bands and an inner gap defined between the confronting inner bands;

the refiner is a thermomechanical refiner that generates steam in the outer gap between the working regions of the outer bands;

at least one of the confronting plates includes a steam bypass channel for directing some of said steam from the outer gap to the inner gap at the inner feeding region while bypassing the inner gap at the inner working region; and the steam bypass channel is formed as a groove on the surface of the working region of the inner band, oriented diagonally through the bars and grooves of said pattern of bars and grooves.

2. The refiner of claim 1, including an annular space between the inner band and the outer band.

3. The refiner of claim 2, wherein the steam bypass channel has an inlet at the annular space between the inner and outer bands.

4. The refiner of claim 1, wherein the inner band and the outer band are distinct members attached to a common refiner disc.

5. The refiner of claim 1, wherein the inner band and the outer band are integrally formed on a common base.

6. The refiner of claim 1, wherein each plate has a total radius extending to the outer circumference of the outer band and each band has a respective radial width, and the radial width of the inner band is less then the radial width of the outer band.

7. The refiner of claim 6, wherein the radial width of the inner band is less than about 35% of said total radius.

8. The refiner of claim 6, wherein the radial width of the feed region of the inner band is greater than the radial width of the working region of the inner band, and the radial width of the feed region in the outer band is less than the radial width of the working region of the outer band.

9. The refiner of claim 6, wherein the pattern of bars and grooves in the working region of the outer band has at least two zones, one of said zones contiguous with the feeding region of the outer band and another of said zones contiguous with the outer circumference of said outer band; and the pattern of bars and grooves in said one zone is less dense than the pattern of bars and grooves in said other zone.

10. The refiner of claim 9, wherein the pattern of bars and grooves throughout the working region of the inner band has a uniform density.

11. The refiner of claim 1, wherein the grooves throughout the working region of the inner band are narrower than the grooves throughout the feeding region of the outer band.

12. The refiner of claim 1, wherein the relatively rotating discs comprise a rotor disc and an opposed stator;

the outer band of the rotor has curved feeding bars in the feeding region; and the feeding region in the outer band on the stator has a substantially flat portion defining a recess for accommodating the curved feeding bars.

13. The refiner of claim 1, wherein the refiner gap includes an inner feed gap between the opposed inner feeding regions, an inner working gap between the opposed inner working regions, an outer feed gap between the opposed outer feeding regions, and an outer working gap between the opposed outer working regions, and the inner working gap has a minimum immediately before a transition to a larger outer feed gap.

14. The refiner of claim 13, wherein the radial width of the feeding region of the inner band is larger than the radial width of the working region of the inner band, and the radial width of the feeding region in the outer band is less than the radial width of the working region of the outer band.

15. The refiner of claim 1, wherein said gap as viewed transversely to the rotation axis has a varying profile from the inner to the outer radius of the plates such that:

a radially inner feeding portion converges radially outwardly to an inner working portion;

the inner working portion extends radially with a minimum gap in the range of about 1.5-3.0 mm to a transition portion;

the transition portion has an abrupt increase in the gap of more than about 4.0 mm leading to an outer working portion; and the outer working portion radially converges to an outer minimum gap in the range of about 0.5-1.0 mm.

16. The refiner of claim 15, wherein the face of at least one of the plates at the gap inner feeding portion comprises a coarse pattern of feeder bars and grooves;

the faces of the plates at the gap inner working portion comprise a fine, defribrating pattern of bars and grooves;

the face of at least one the plates at the transition portion of the gap comprises a coarse feeder pattern of bars and grooves; and the faces of the plates at the outer working portion of the gap comprise a fine, fibrillating pattern of bars and grooves.

17. The refiner of claim 16, wherein the grooves of the defibrating pattern at the minimum of the inner working gap are narrower than the grooves of the coarse feeder pattern at the transition portion of the gap.

18. The refiner of claim 1, comprising:

a first plate having inner and outer radii $R_i$, $R_o$ and a working face including a pattern of raised and relief structures;

a second plate having inner and outer radii $R_i$, $R_o$ and a working face including a pattern of raised and relief structures;

whereby a radially dependent flow area A for the lignocellulosic material extends from the inner radius $R_i$ to the outer radius $R_o$, such that $dA/dr<0$ from $R_i$ to $R_a$ $dA/dr>0$ from $R_a$ to $R_b$ $dA/dr<0$ from $R_b$ to $R_o$ where $R_i<R_a<R_b<R_o$.

19. The refiner of claim 18, wherein the diameter of the plates is at least about 36 inches, A is defined in part by a radially extending gap between the opposed plates, and the dA/dr at a radius immediately outside $R_a$ is defined by the combination of said gap and a transition from a relatively fine pattern of bars and grooves on each of the opposed plates at $R_a$, to a coarse pattern of bars, grooves or recesses immediately outside $R_a$.

* * * * *